US009156287B2

(12) United States Patent
Aoki

(10) Patent No.: US 9,156,287 B2
(45) Date of Patent: Oct. 13, 2015

(54) MEDIUM TRANSPORT DEVICE AND RECORDING APPARATUS WITH A SHARED TRANSPORT PATH

(71) Applicant: SEIKO EPSON CORPORATION, Tokyo (JP)

(72) Inventor: Takeshi Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/488,944

(22) Filed: Sep. 17, 2014

(65) Prior Publication Data

US 2015/0109392 A1 Apr. 23, 2015

(30) Foreign Application Priority Data

Oct. 18, 2013 (JP) ..... 2013-217608

(51) Int. Cl.
*B41J 11/04* (2006.01)

(52) U.S. Cl.
CPC ..... *B41J 11/04* (2013.01)

(58) Field of Classification Search
CPC ..... B41J 13/009; B41J 13/0045; B41J 3/60; B41J 17/14
USPC ..... 347/104, 101; 271/186, 187, 291, 9.13, 271/9.09, 9.11, 9.01
See application file for complete search history.

(56) References Cited

U.S. PATENT DOCUMENTS 6,152,561 A 11/2000 Watanabe

FOREIGN PATENT DOCUMENTS

JP 10-129860 5/1998
JP 2001-122528 * 5/2001 ..... B65H 85/00

* cited by examiner

*Primary Examiner* — Henok Legesse
(74) *Attorney, Agent, or Firm* — Workman Nydegger

(57) ABSTRACT

A medium transport device includes a medium transport pathway that inverts a medium that is supplied from a processing unit and is capable of transporting the medium to the processing unit again, a plurality of supply units that supply media, and a plurality of convergence units at which the plurality of supply units and the medium transport route converge. A transport roller is provided in each convergence unit.

7 Claims, 16 Drawing Sheets

MEDIUM TRANSPORT DEVICE AND RECORDING APPARATUS WITH A SHARED TRANSPORT PATH

BACKGROUND

1. Technical Field

The present invention relates to a medium transport device and recording apparatus that is provided with the medium transport device.

In the present application, a recording apparatus includes kinds such as ink jet printers, line printers, copy machines and facsimiles.

2. Related Art

In ink jet printers of the related art, a medium is transported from a medium accommodation cassette, which is attached to a printer main body in a detachable manner, to a position that is opposite to a recording head, and recording is executed on the medium at the position that is opposite to the recording head. Among ink jet printers, other than the medium accommodation cassette, there are printers that are provided with a medium accommodation tray above a back surface side of the printer main body (refer to JP-A-10-129860), and there are printers that are provided with a manual insertion pathway that supplies a medium to the printer one sheet at a time, and transports the medium to a position that is opposite to the recording head (refer to JP-A-2001-122528).

The recording apparatus that is disclosed in JP-A-10-129860 is configured to be provided with an auto-sheet feeder (ASF), which is a first sheet supporting means that is disposed above a rear portion of an apparatus main body, and a sheet cassette, which is a second sheet supporting means that is disposed below the front of the apparatus main body. In the recording apparatus, sheets (media) that are supported by the first sheet supporting means pass through a first sheet feeding route that is provided inside the apparatus main body, and are transported to a position that is opposite to the recording head through a common transport route that is positioned on an upstream side of the recording head in a sheet transport direction. In addition, sheets that are supported by the second sheet supporting means pass through a second sheet feeding route that is provided inside the apparatus main body, and are transported to a position that is opposite to the recording head through the common transport route that is positioned on an upstream side of the recording head in a sheet transport direction.

In the recording apparatus, in addition to the common transport route being formed inside the apparatus main body, the sheet feeding routes (the first sheet feeding route and the second sheet feeding route) are respectively formed in the first sheet supporting means that supplies sheets from an upper side with respect to the common transport route and the second sheet supporting means that supplies sheets from a lower side with respect to the common transport route. Therefore, inside the apparatus main body, the common transport route, the first sheet feeding route and the second sheet feeding route are provided separately, and there is a concern that the amount of space that the sheet feeding routes occupy in the recording apparatus may increase, and that the size of the recording apparatus may be increased as a result.

In addition, the recording apparatus that is disclosed in JP-A-2001-122528 is configured to be provided with an auto-sheet feeder (ASF), which is disposed above a rear portion of an apparatus main body, a cassette, which is a feeding unit that is disposed below the front of the apparatus main body, a manual insertion feeding opening that is disposed in a rear portion of the apparatus main body, an image processing unit that forms images on a medium, and a transport roller that transports sheets (media) that are supplied from the auto-sheet feeder, the cassette and the manual insertion feeding opening to the image processing unit using the outer peripheral surfaces thereof.

In the recording apparatus, the transport roller configures an upper transport route and a lower transport route. Sheets that are supported by the cassette are transported along the outer peripheral surface of the transport roller after being delivered from the cassette, and are transported to the image processing unit through the upper transport route. In addition, sheets that are supported by the auto-sheet feeder are transported to the image processing unit through the upper transport route. On the other hand, sheets that are supplied from the manual insertion feeding opening are transported to the image processing unit through the lower transport route using the transport roller, which rotates in a direction that is opposite to the direction of rotation during transport of sheets that are supported by the cassette and sheets that are supported by the auto-sheet feeder.

In addition, in the recording apparatus, sheets that are supported by the cassette and sheets that are supported by the auto-sheet feeder are transported to an upper position of the upper transport route that is positioned above the transport roller. In addition, sheets that are supplied from the manual insertion feeding opening are transported to a lower position of the lower transport route that is positioned below the transport roller. Further, the image processing unit is configured to be capable of swinging between the upper position and the lower position.

Therefore, in the recording apparatus, since a plurality of pathways that transport media to the image processing unit are formed in the transport pathway that has a plurality of sheet feeding pathways, the configuration of the transport pathway is complicated. As a result of this, there is a concern that the amount of space that the transport pathway occupies in the recording apparatus may increase, and that the size of the recording apparatus may be increased as a result.

SUMMARY

An advantage of some aspects of the invention is to provide a medium transport device and a recording apparatus that can reduce the amount of space that a transport pathway that has a plurality of medium supply pathways occupies in a recording apparatus by simplifying the configuration of the transport pathway.

According to an aspect of the invention, there is provided a medium transport device including a medium transport pathway that inverts a medium that is supplied from a processing unit that executes a process on the medium, and is capable of transporting the medium to the processing unit again and a discharge unit that discharges the medium that is supplied from the processing unit. Furthermore, the medium transport device includes a third supply unit that supplies a first medium, a first convergence unit at which the third supply unit and the medium transport route converge, a second supply unit that supplies a second medium, and a second convergence unit that is positioned further downstream than the first convergence unit, and at which the second supply unit and the medium transport pathway converge. Furthermore, the medium transport device includes a first transport roller that is provided in the first convergence unit, and a second transport roller that is provided in the second convergence unit.

In this case, since it is possible to adopt a configuration that provides convergence positions from each supply unit along a transport direction of the medium transport route, and therefore possible to make the transport pathways of media from each supply unit to the processing unit a single transport pathway, it is possible to simplify the configuration of the medium transport device. As a result of this, it is possible to reduce the amount of space that the medium transport device occupies.

In addition, since it is possible to respectively set the convergence positions in the medium transport pathway from each supply unit to have different positions, it is possible to perform the transport of a variety of media that are supplied from each supply unit, the length in the transport direction and the rigidity of which differ, along the transport routes from the convergence positions that are respectively appropriate for the media. As a result of this, it is possible to execute processing of a wide variety of media in a recording apparatus, and therefore, it is possible to improve the usability of the recording apparatus.

In addition, since the media are transported by a transport roller that is provided in each convergence unit, it is possible to reduce the number of times that a medium is transported by transport rollers, and therefore, it is possible to suppress a concern that marks will be left on the surface of a medium by the transport rollers.

In the medium transport device, the first transport roller may be provided with a first driving roller, and a first driven roller.

In the medium transport device, a first supply unit that supplies a third medium, a third convergence unit that is positioned further upstream than the first convergence unit, and at which the first supply unit and the medium transport pathway converge, and a third transport roller that is provided in the third convergence unit, may be further provided.

In the medium transport device, the medium transport pathway that converges at the third convergence unit may be a medium transport pathway for reverse face processing that processes a reverse face of a medium by transporting the medium that is supplied from the processing unit to the processing unit again.

In the medium transport device, the medium transport pathway for reverse face processing may be disposed in a substantially flat manner. Further, a pathway from the first supply unit that converges with the third convergence unit may converge upward from a position below the medium transport pathway for reverse face processing.

In this case, since the medium transport pathway for reverse face processing is disposed in a substantially flat manner, in order to transport the medium to the processing unit again, it is possible to transport by merely reversing the transport without providing a guide member such as a flap. Further, by causing a pathway from the first supply unit that converges with the third convergence unit to converge upward from a position below the medium transport pathway for reverse face processing, it is possible to suppress increases in the size of the medium transport device.

In the medium transport device, the first convergence unit, the second convergence unit and the third convergence unit may be positioned in the area surrounding the first driving roller of the first transport roller.

In this case, it is possible to reliably nip media that have been supplied from each supply unit at each convergence position, and therefore, it is possible to make guiding of the media to the medium transport pathways smooth. In addition, since all of the media converge on the first driving roller, it is possible to suppress increases in the size of the medium transport device.

In the medium transport device, the second transport roller and the third transport roller may be provided with a common second driving roller, a second driven roller that is provided in the second convergence unit in the area surrounding the second driving roller, and a third driven roller that is provided in the third convergence unit in the area surrounding the second driving roller.

In this case, by adjusting the distance between the first driving roller and second driving roller, it is possible to make the distance to transport the medium to the processing unit again, longer. As a result of this, it is possible to make a pathway length longer without increasing the diameter of the transport driving rollers, and therefore, it is possible to suppress increases in the size of the device in the height direction.

In the medium transport device, the diameters of the first driving roller and the second driving roller may be the same.

In this case, it is possible to configure the first driving roller and the second driving roller with a common member, and therefore, it is possible to achieve a reduction in cost. Since the diameters of the first driving roller and the second driving roller are the same, it is possible to easily make the circumferential speeds of the outer peripheries of the driving rollers, that is, the sheet transport speeds, uniform by making the number of rotations of both driving rollers the same. In addition, since it is possible to make the sheet transport speeds uniform, a circumstance in which a pulling force is applied to the medium between the first driving roller and the second driving roller and a circumstance in which the medium becomes curved are avoided. As a result of this, it is possible to favorably transport media. In addition, since it is possible to provide the first driving roller and the second driving roller in positions that overlap one another in the height direction, it is possible to suppress the dimensions of a disposition range in a height direction to a minimum.

In the medium transport device, the first driving roller and the second driving roller may be configured to be a detachable unit body.

In this case, it is possible to easily perform a jam removal process of a medium.

According to another aspect of the invention, there is provided a recording apparatus including a processing unit that performs a process on a medium, and the medium transport device according to the aspect.

In this case, it is possible to obtain the same effects as the functional effects mentioned above in a recording apparatus.

According to still another aspect of the invention, there is provided a medium transport device including a transport unit that has a medium transport pathway that transports media prior to processing toward a side of a processing unit that performs a process on the media or transports media on which processing has been performed by the processing unit toward a side of the processing unit again by inverting the media, a plurality of supply units that supply the media prior to processing to the transport unit, and a reverse transport unit that reverses the transport of the media from the processing unit to the transport unit in order to invert the media on which processing has been performed by the processing unit. The transport unit has at least the same number of convergence positions as the number of supply units inside the medium transport pathway, the media that are supplied from the plurality of supply units respectively converge with the medium transport pathway at different convergence positions, the media, the transport of which is reversed from the reverse transport unit to the transport unit, pass at least one of the plurality of convergence positions and converge with the medium transport pathway.

In this case, the media that are supplied from the plurality of supply units respectively converge with the medium transport pathway at different convergence positions, and the media, the transport of which is reversed from the reverse transport unit to the transport unit, pass at least one of the plurality of convergence positions and converge with the medium transport pathway. Therefore, it is possible to make a transport pathway from the plurality of supply units to the processing unit and the transport pathway of the media from the reverse transport unit, that is, an inverse pathway, common. In addition, since it is possible to respectively set the convergence positions in the medium transport pathway from each supply unit, it is possible to adopt a configuration in which the convergence positions from each supply unit are provided along the transport direction of the medium transport pathway, and therefore, since it is possible to set the transport pathway of the media from each supply unit to the processing unit to be a single transport pathway, it is possible to simplify the configuration of the medium transport device. As a result of this, it is possible to reduce the amount of space that the medium transport device occupies in the recording apparatus.

In addition, since it is possible to separately set the convergence positions in the medium transport pathway from each supply unit, it is possible to perform the transport of a variety of media, the length in the transport direction and the rigidity of which differ, along the transport pathways from the convergence positions that are respectively appropriate for the media. As a result of this, it is possible to execute processing of a wide variety of media in the recording apparatus, and therefore, it is possible to improve the usability of the recording apparatus.

In the medium transport device, the transport unit may be provided with a bent portion that inverts the media that is reverse transported in the medium transport pathway by the reverse transport unit, the plurality of supply units may be provided with a third supply unit, and a medium supply pathway from the third supply unit may converge with a reverse transport pathway of a medium that is reverse transported from the reverse transport unit to the transport unit, and pass through a first convergence position, which is a convergence position that is furthest away from the processing unit in a medium transport pathway that leads toward the processing unit, via the bent portion.

In the medium transport device, the plurality of supply units may be provided with a second supply unit, and a medium supply pathway from the second supply unit may converge with the medium transport pathway by passing a second convergence position, which is a convergence position that is positioned further downstream than the bent portion and is closest to the processing unit in the medium transport pathway that leads toward the processing unit.

In this case, since the medium supply pathway from the second supply unit converges with the medium transport pathway by passing a second convergence position, which is a convergence position that is positioned further downstream than the bent portion and is closest to the processing unit in the medium transport pathway that leads toward the processing unit, it is possible to reduce the length of the medium transport pathway that leads toward the processing unit from the second supply unit. For example, in a case in which a medium that is transported has high rigidity, there is a concern that the medium will not follow the pathway of the medium transport pathway and become curved when the medium is transported along the medium transport pathway, and therefore, that a paper jam will be caused in the medium transport pathway. Therefore, by reducing the transport pathway length of the medium transport pathway as much as possible, it is possible to suppress a concern that a medium with high rigidity will cause a paper jam in the medium transport pathway.

In the medium transport device, the plurality of supply units may be provided with a first supply unit, and a medium supply pathway from the first supply unit may converge with the medium transport pathway by passing a third convergence position that is positioned at the bent portion between the first convergence position and the second convergence position in the medium transport pathway that leads toward the processing unit.

In this case, the medium supply pathway from the first supply unit is configured to converge with the medium transport pathway by passing a third convergence position that is positioned at the bent portion between the first convergence position and the second convergence position. In this instance, by converging with the medium transport pathway at the third convergence position, a transport direction of a medium that is supplied from the first supply unit is changed along the bent portion. As a result of this, the medium is transported along the medium transport pathway toward the processing unit. Therefore, since the transport direction of a medium that is supplied from the first supply unit is changed along the bent portion from the third convergence position, it is possible to smoothly transport the medium toward the processing unit.

In addition, for example, in a case in which the first supply unit is configured as a paper supply cassette, the frequency of use of the medium supply pathway from the first supply unit is the highest. In the present embodiment, in the medium transport pathway in which the frequency of use is highest, it is possible to make the convergence from the medium supply pathway from the first supply unit to the medium transport pathway smooth, and therefore, it is possible to change the transport direction of the medium that is transported smoothly. Therefore, it is possible to suppress circumstances in which paper jams and transport defects are caused in the transport pathway of the medium from the first supply unit to the processing unit.

In the medium transport device, a medium that is supplied from the third supply unit may be transported to the processing unit by passing the first convergence position, the third convergence position and the second convergence position.

In the medium transport device, a medium that is supplied from the second supply unit may be transported to the processing unit by passing the second convergence position only.

In this case, since a medium that is supplied from the second supply unit is transported to the processing unit by passing the second convergence position only, it is possible to reduce the transport pathway length, and it is easy to configure the transport pathway in a linear manner. Therefore, it is possible to suppress the medium from being bent and marks from being left on the medium in the medium transport pathway from the second supply unit to the processing unit when a medium with high rigidity or a medium in which it is not desirable to bend the paper surface are transported.

In the medium transport device, a medium that is supplied from the first supply unit may be transported to the processing unit by passing the third convergence position and the second convergence position.

In this case, a medium that is supplied from the first supply unit is transported to the processing unit by passing the third convergence position, which is positioned at the bent portion, and the second convergence position. In this instance, by converging with the medium transport pathway at the third convergence position, a transport direction of a medium that is supplied from the first supply unit is changed along the bent portion. As a result of this, the medium is transported along the medium transport pathway toward the processing unit by passing the second convergence position. Therefore, since the transport direction of a medium that is supplied from the first supply unit is changed along the bent portion from the third convergence position, it is possible to smoothly transport the medium toward the processing unit. Therefore, it is possible to suppress circumstances in which paper jams and transport defects are caused in the transport pathway of the medium from the first supply unit to the processing unit.

In the medium transport device, the transport unit may be provided with a single transport roller, and a driven roller that is positioned so as to nip the medium with the transport roller at at least the first convergence position, the second convergence position and the third convergence position.

In this case, since the transport unit is provided with a single transport roller, and a driven roller that is positioned so as to nip the medium with the transport roller at at least the first convergence position, the second convergence position and the third convergence position, it is possible to reliably nip media that are supplied from each supply unit at each of the convergence positions, and therefore, it is possible to make guiding of the media to the medium transport pathways smooth.

In the medium transport device, the transport unit may be provided with at least two transport rollers, and a driven roller that is positioned so as to nip the medium with the transport rollers at at least the first convergence position, the second convergence position and the third convergence position, and in the at least two transport rollers, a nipping point at the first convergence position and a nipping point at the second convergence position may be formed in a transport roller on a side that is closer to the processing unit.

In this case, in the at least two transport rollers, a nipping point at the first convergence position and a nipping point at the second convergence position are formed in a transport roller on a side that is closer to the processing unit. Further, the nipping point at the first convergence position also doubles as a convergence point from the reverse transport unit. Therefore, since media that is reverse transported from the reverse transport unit reaches the processing unit from the nipping point at the first convergence position via the nipping point at the third convergence position and the nipping point at the second convergence position, the inverse pathway is longer. In addition, by adjusting the distance between at least two transport rollers, it is possible to make the inverse pathway length longer. As a result of this, it is possible to make the inverse pathway length longer without increasing the diameter of the transport rollers, and therefore, it is possible to suppress an increase in the size in the height direction of the apparatus.

In addition, in a medium transport pathway that reaches the processing unit from the second supply unit, since the medium is nipped at the nipping point at the second convergence position only, it is possible to reduce the number of times that the medium is nipped by the transport rollers, and therefore, it is possible to suppress a concern that marks will be left on a medium surface as a result of nipping by the transport rollers.

In the medium transport device, the transport unit may be provided with a plurality of pairs of transport rollers that are respectively formed at at least the first convergence position, the second convergence position and the third convergence position.

In this case, since the transport unit is provided with a plurality of pairs of transport rollers that are respectively formed at at least the first convergence position, the second convergence position and the third convergence position, it is possible to make the inverse pathway length longer without increasing the diameter of the transport rollers, and therefore, it is possible to suppress an increase in the size in the height direction of the apparatus.

According to still another aspect of the invention, there is provided a recording apparatus including a processing unit that performs a process on a medium, and the medium transport device.

In this case, it is possible to obtain the same effects as the functional effects mentioned above in a recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
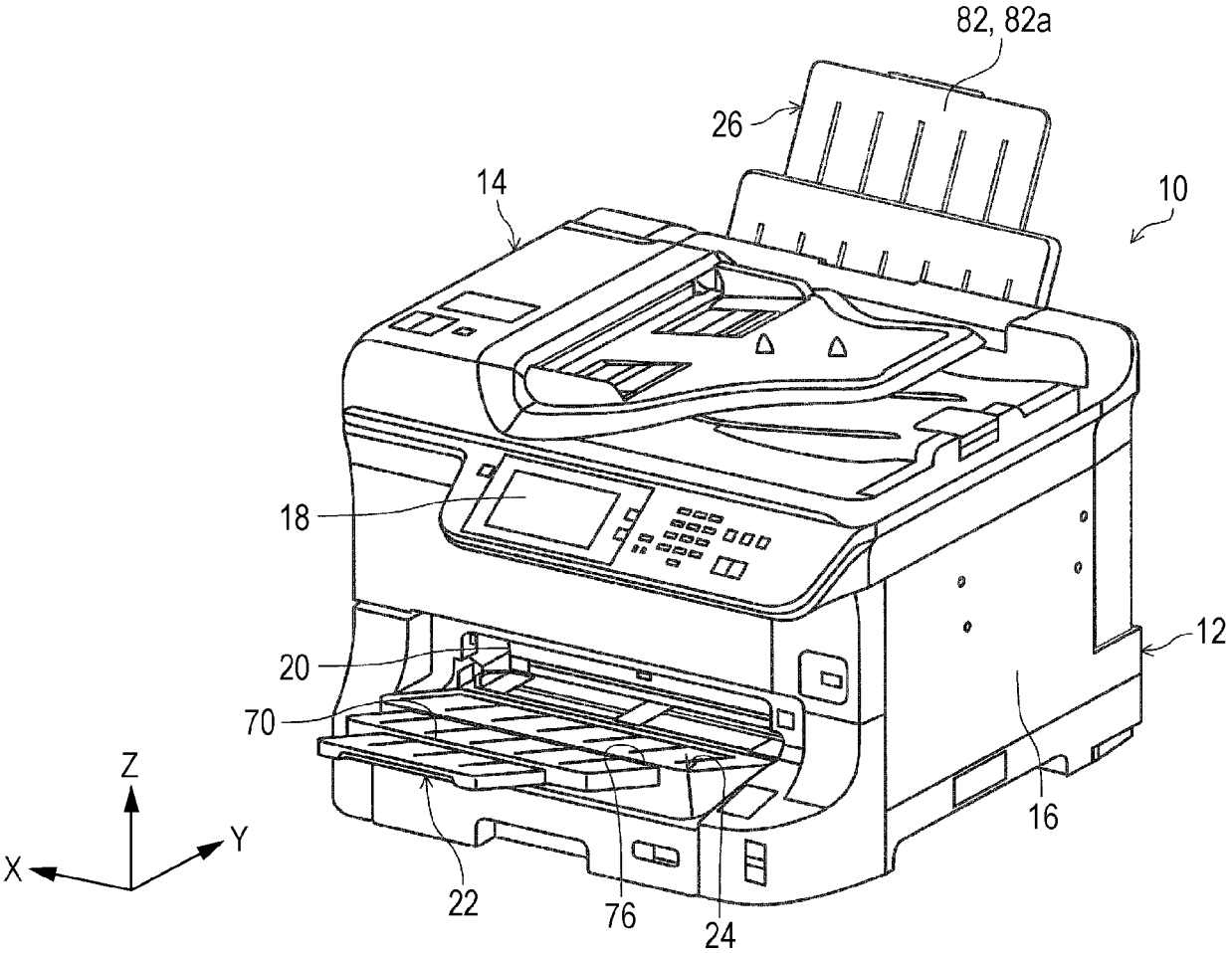
FIG. 1 is a perspective view of a printer according to the invention.

Hereinafter, embodiments of the invention will be described on the basis of the drawings. Additionally, similar configurations in each embodiment will be given the same reference numeral, and descriptions of the configurations thereof will only be given in the first embodiment in which they appear with further descriptions being omitted from later embodiments.

Figure 2:
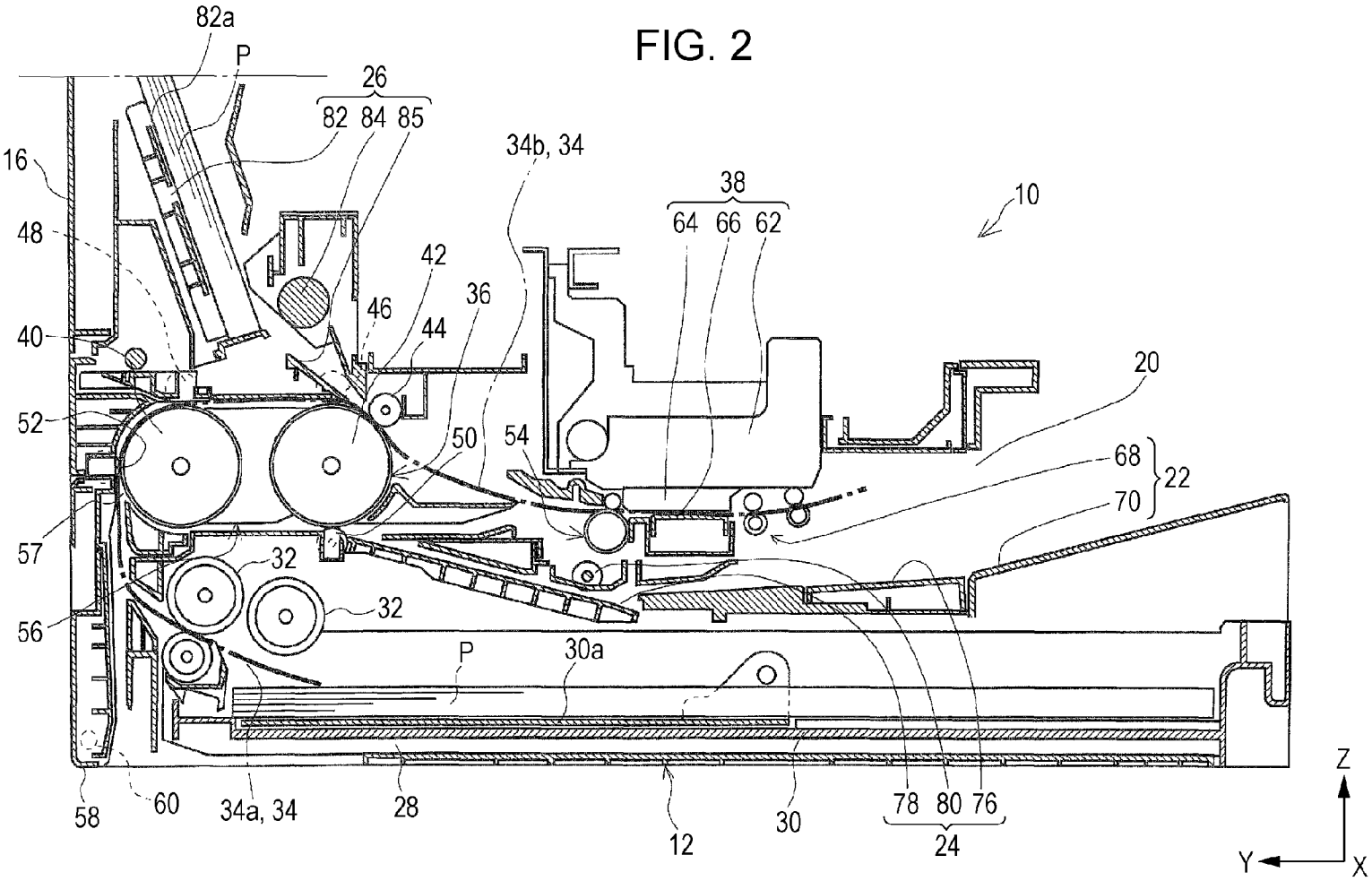
FIG. 2 is a sectional side view that shows a medium transport pathway from a medium accommodation unit of the printer according to the invention.
Figure 3:
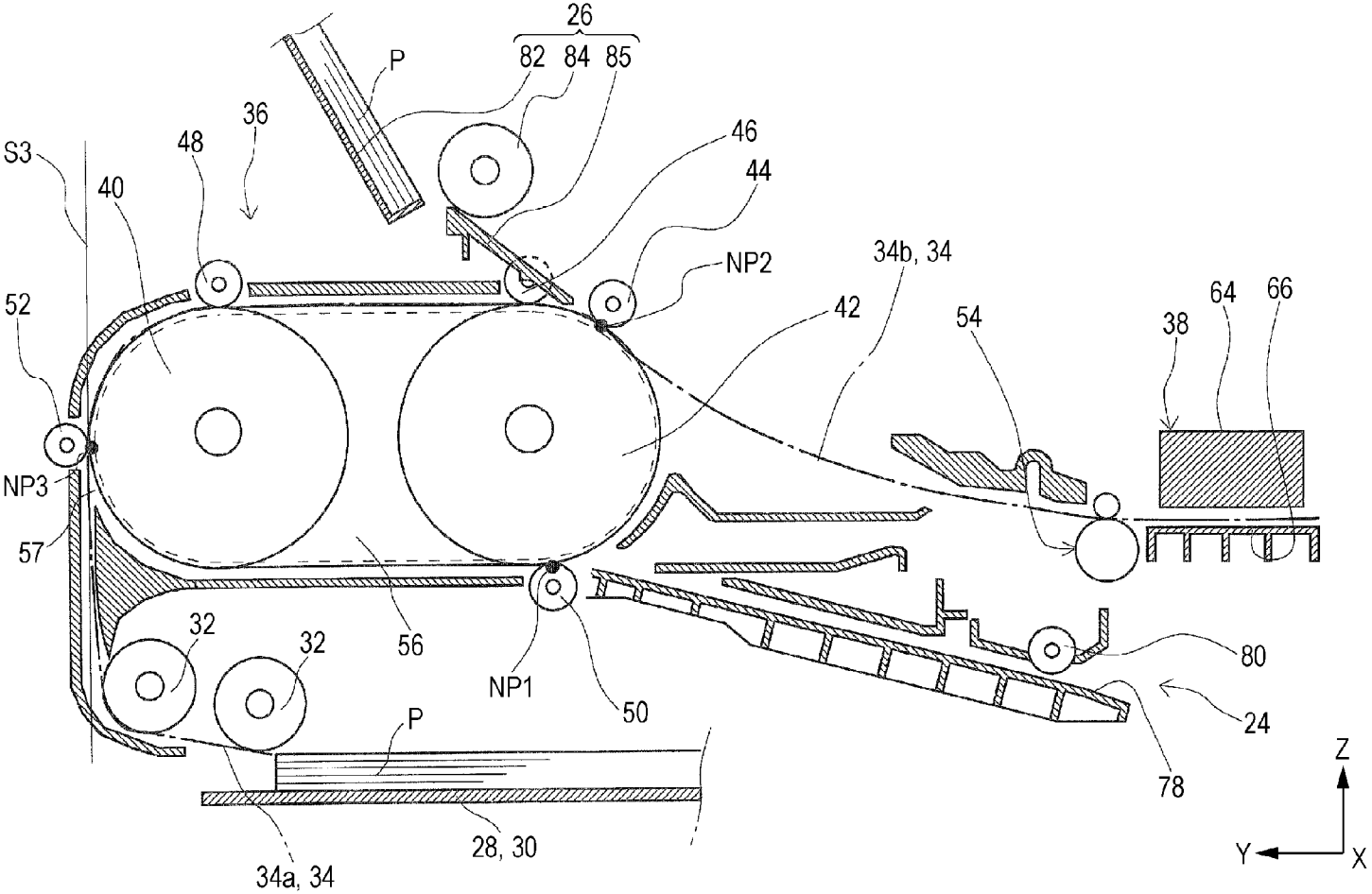
FIG. 3 is an outline view of the medium transport pathway from the medium accommodation unit in a transport unit according to the invention.
Figure 4:
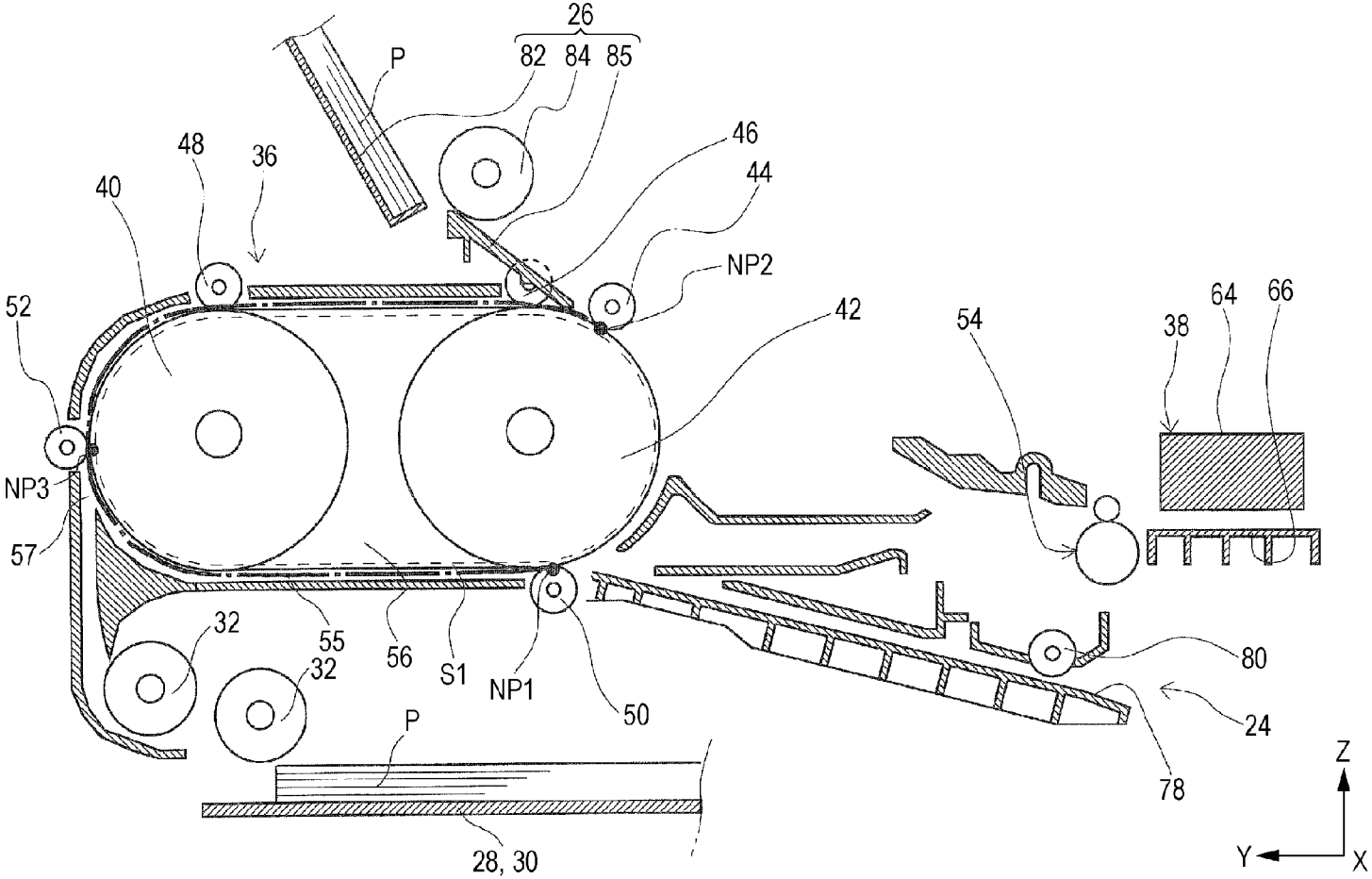
FIG. 4 is an outline view that shows a medium transport pathway in the transport unit in the printer according to the invention.
Figure 5:
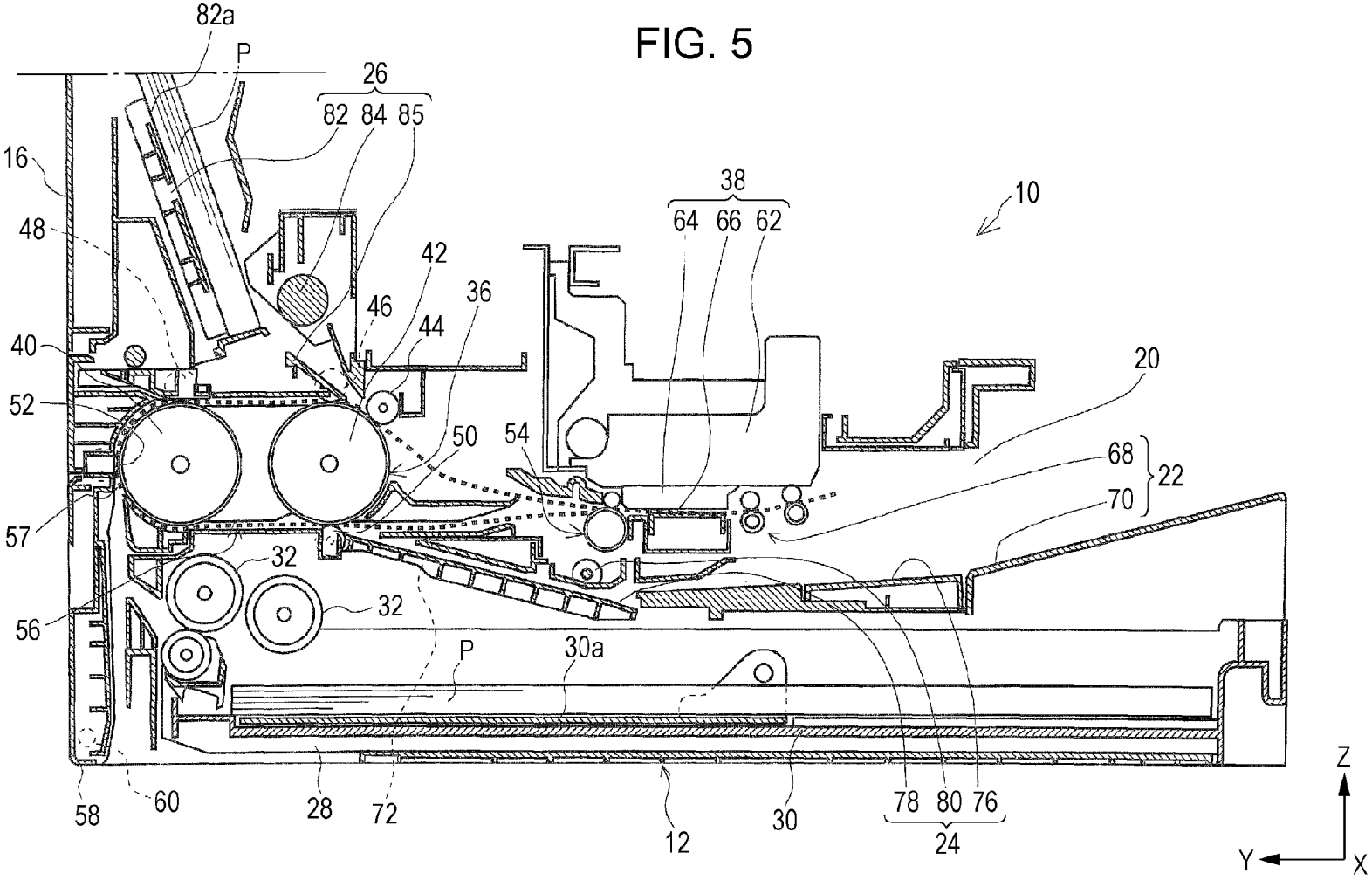
FIG. 5 is a sectional side view that shows a reverse transport pathway from a recording unit in the printer according to the invention.

FIG. 1 is a perspective view of a printer according to the invention, FIG. 2 is a sectional side view that shows a medium transport pathway from a medium accommodation unit of the printer according to the invention, FIG. 3 is an outline view of the medium transport pathway from the medium accommodation unit in a transport unit according to the invention, FIG. 4 is an outline view that shows a medium transport pathway in the transport unit in the printer according to the invention, and FIG. 5 is a sectional side view that shows a reverse transport pathway from a recording unit in the printer according to the invention.

Figure 6:
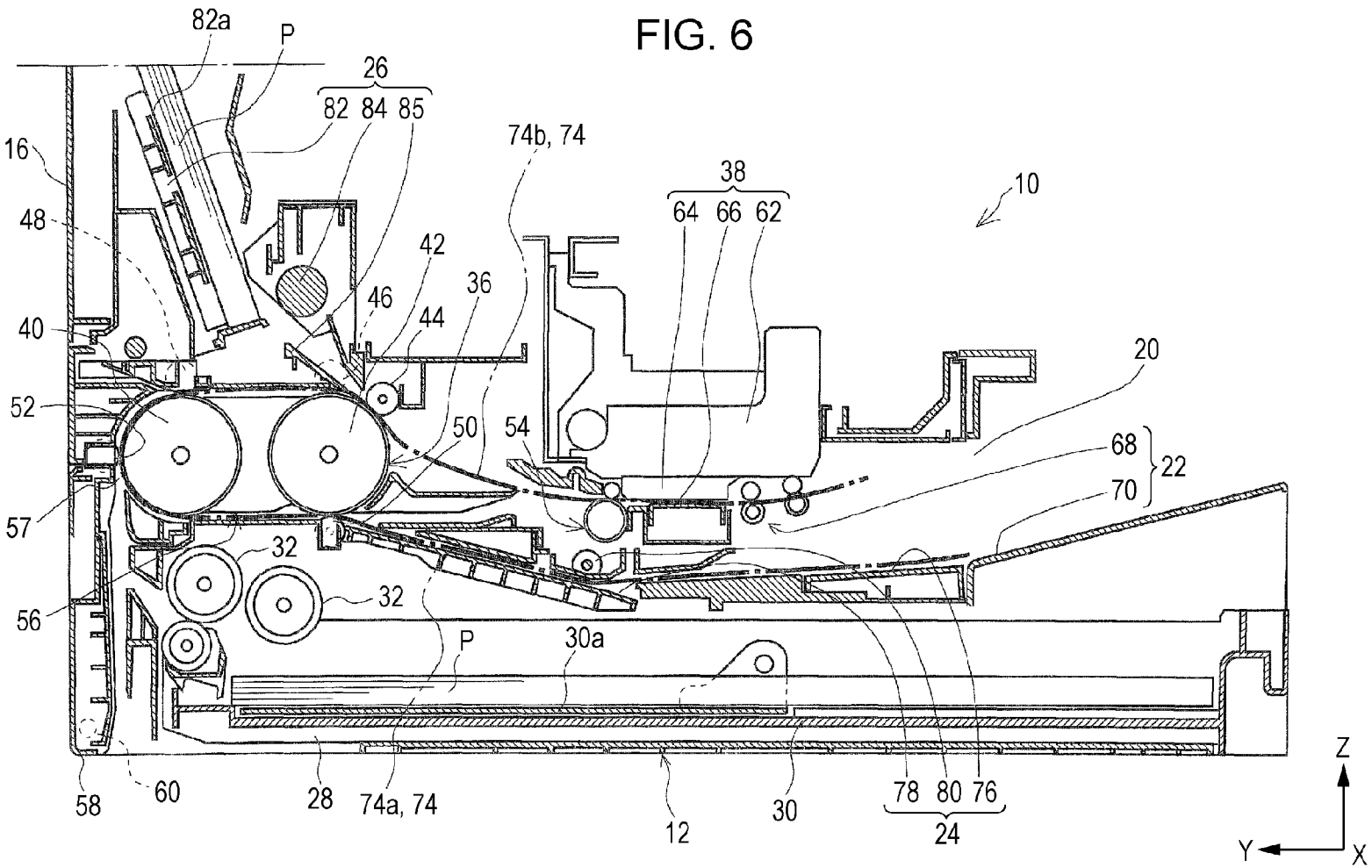
FIG. 6 is a sectional side view that shows a medium transport pathway from a front surface manual insertion pathway in the printer according to the invention.
Figure 7:
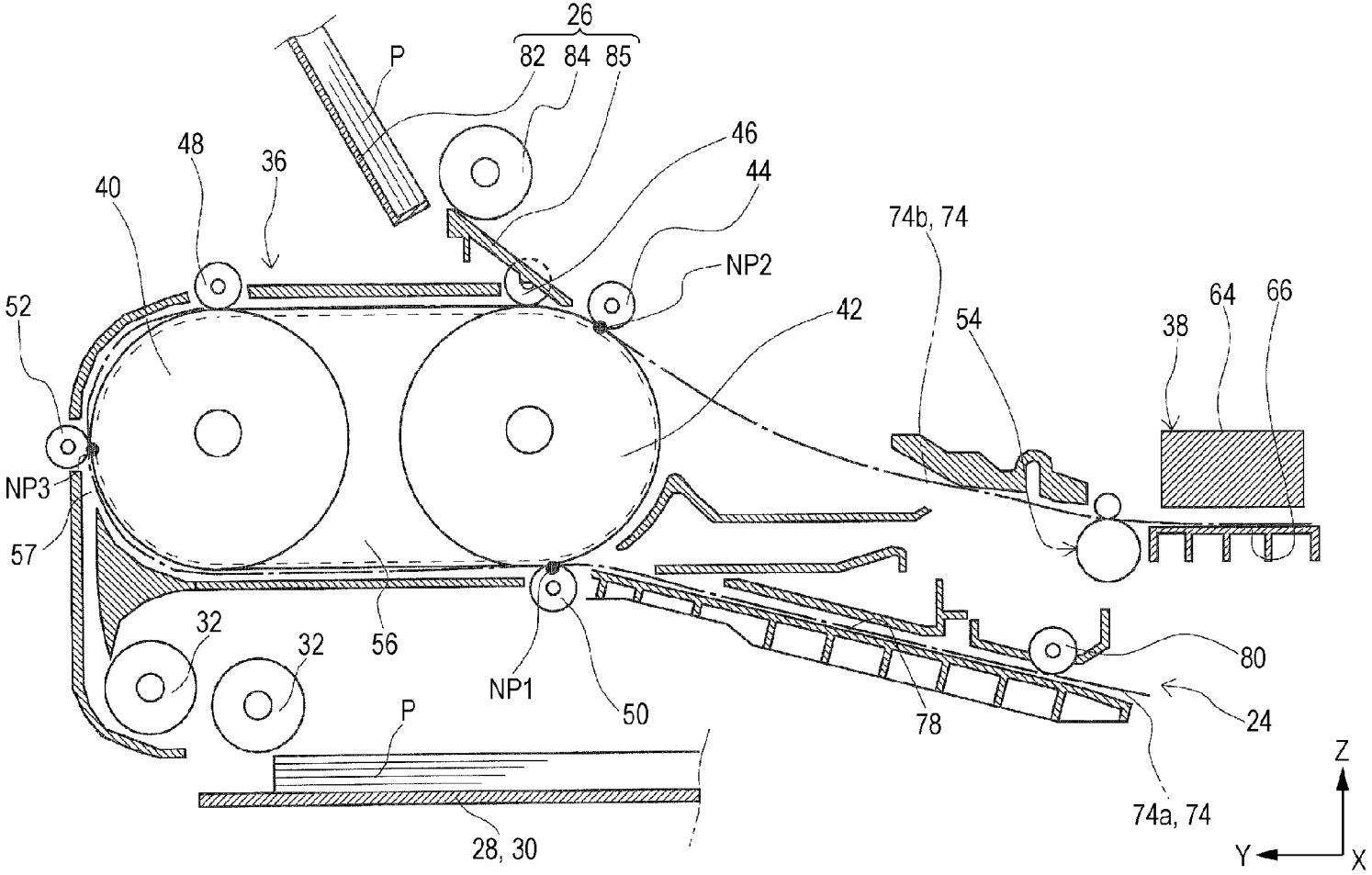
FIG. 7 is an outline view that shows the medium transport pathway from the front surface manual insertion pathway in the printer according to the invention.
Figure 8:
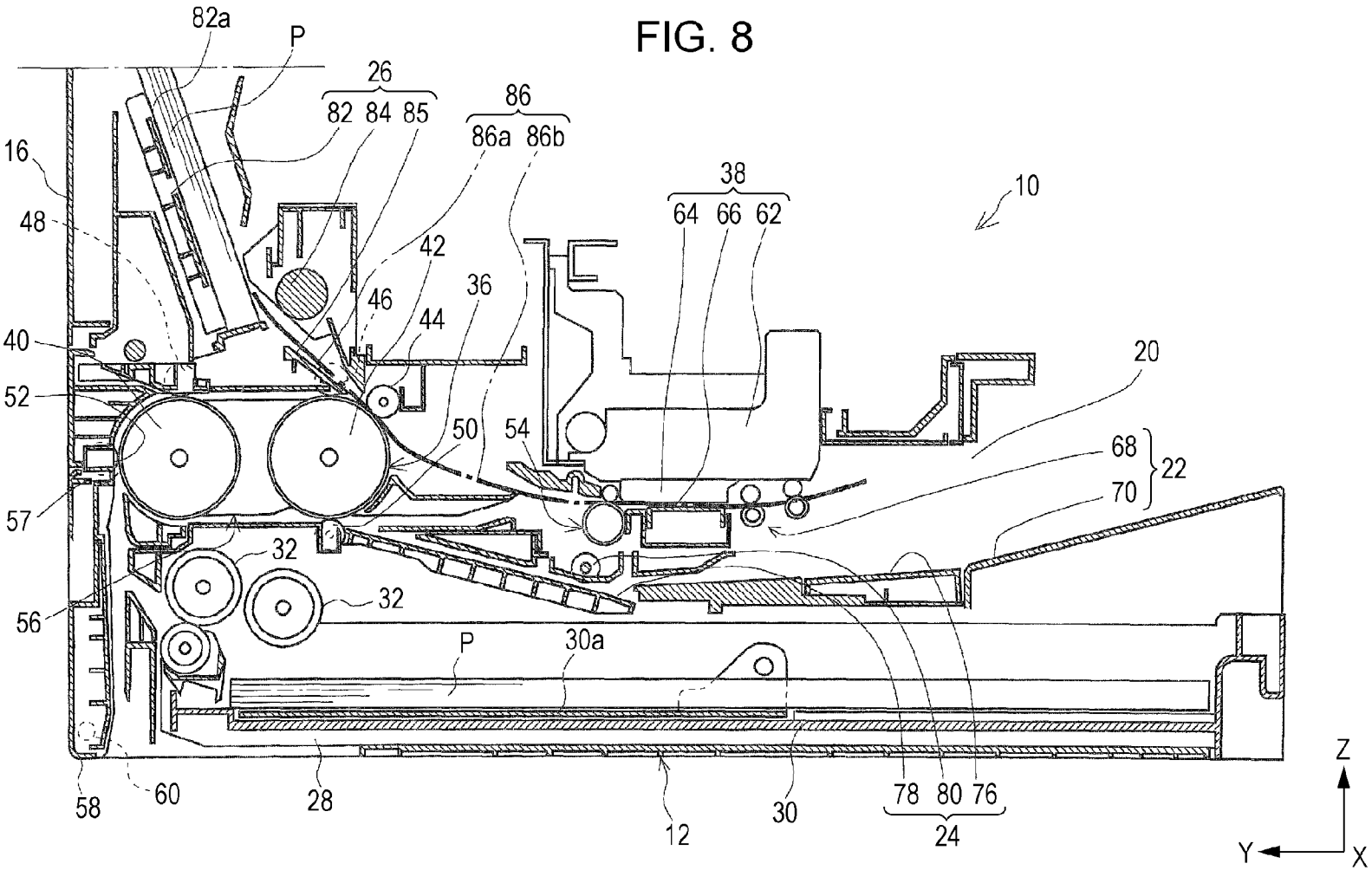
FIG. 8 is a sectional side view that shows a medium transport pathway from a back surface feeding unit in the printer according to the invention.
Figure 9:
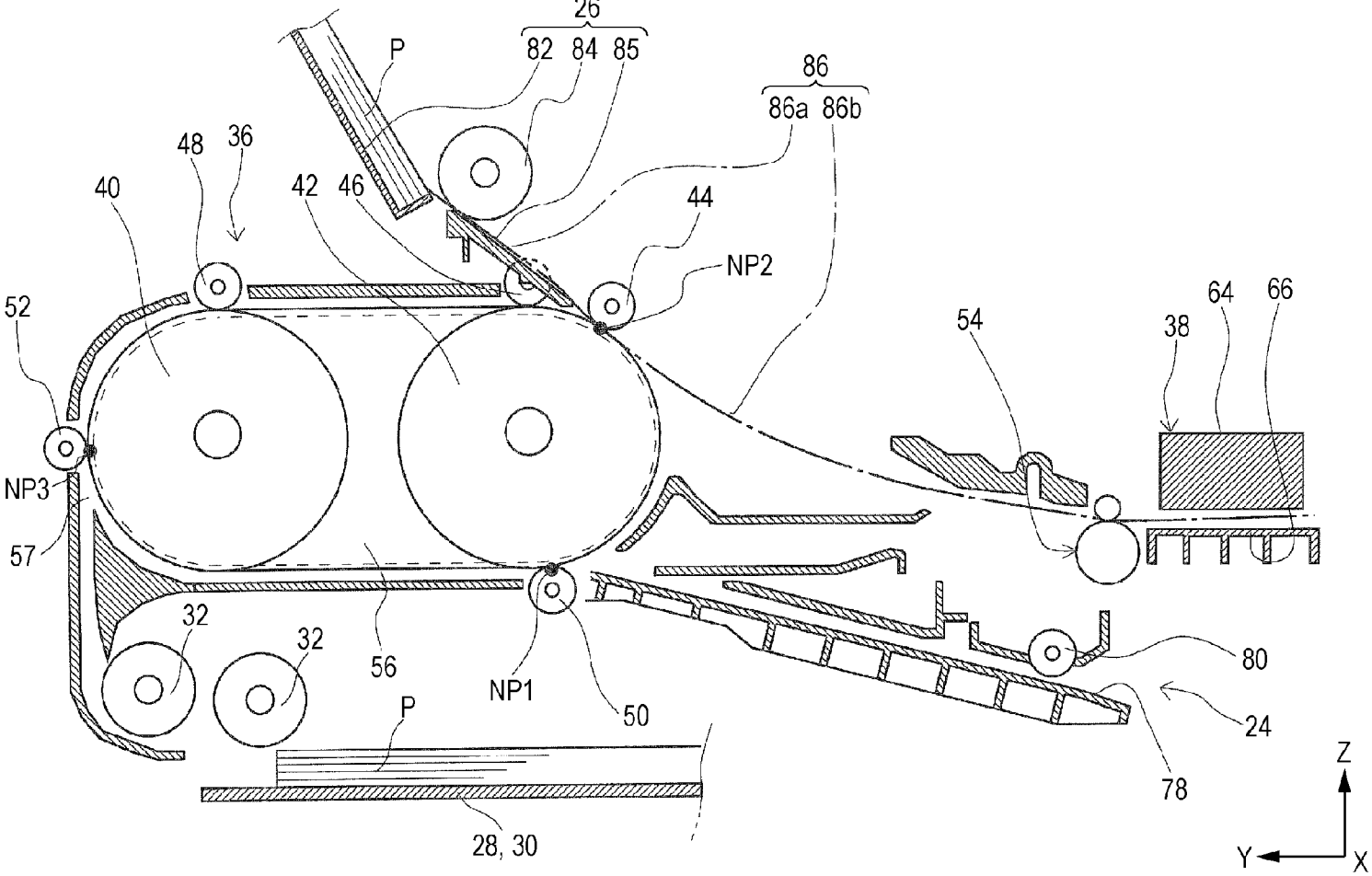
FIG. 9 is an outline view that shows the medium transport pathway from the back surface feeding unit in the printer according to the invention.
Figure 10:
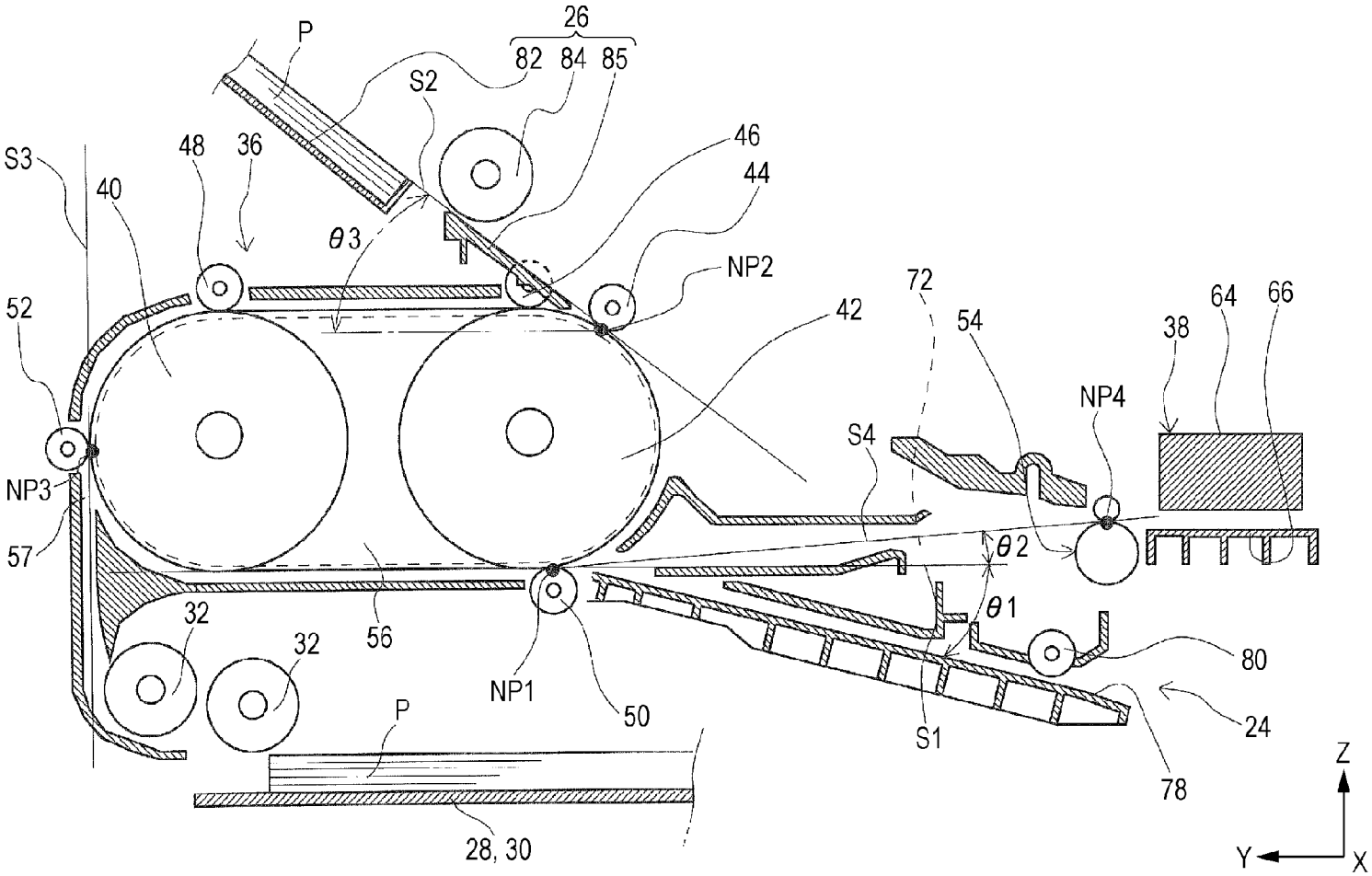
FIG. 10 is an outline view that shows a relationship between each medium transport pathway in the transport unit in the printer according to the invention.
Figure 11:
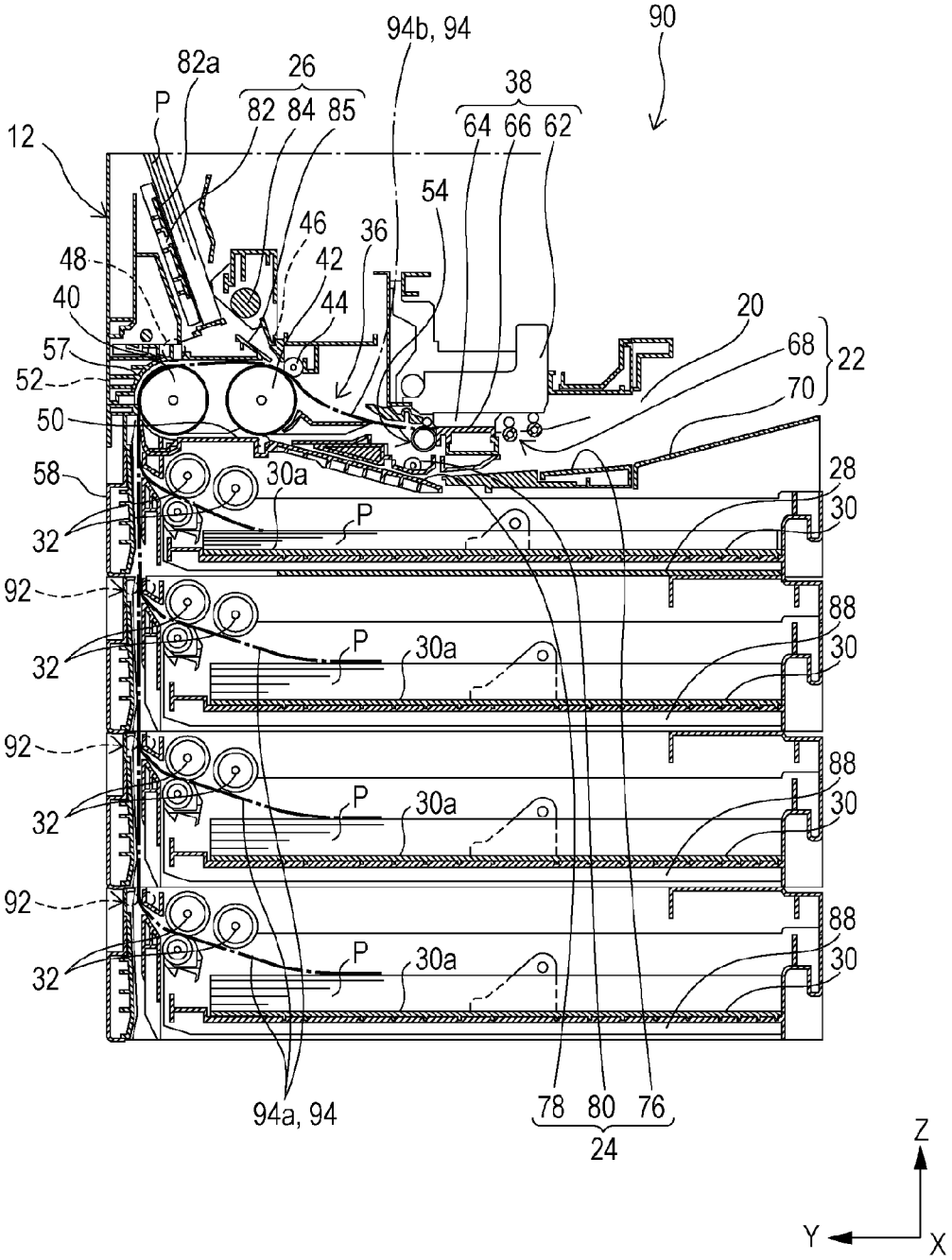
FIG. 11 is a sectional side view that shows a modification example of a printer according to a first embodiment.

FIG. 6 is a sectional side view that shows a medium transport pathway from a front surface manual insertion pathway in the printer according to the invention, FIG. 7 is an outline view that shows the medium transport pathway from the front surface manual insertion pathway in the printer according to the invention, FIG. 8 is a sectional side view that shows a medium transport pathway from a back surface feeding unit in the printer according to the invention, FIG. 9 is an outline view that shows the medium transport pathway from the back surface feeding unit in the printer according to the invention, FIG. 10 is an outline view that shows a relationship between each medium transport pathway in the transport unit in the printer according to the invention, and FIG. 11 is a sectional side view that shows a modification example of a printer according to a first embodiment.

Figure 12A:
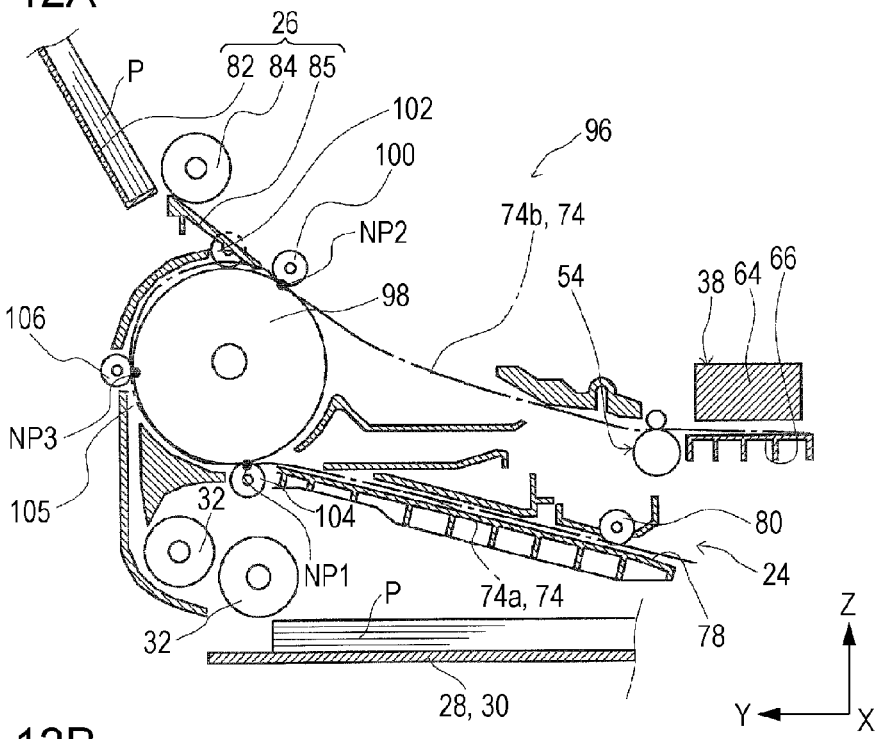
FIG. 12A is a sectional side view that shows a medium transport pathway from a front surface manual insertion pathway in a second embodiment.
Figure 12B:
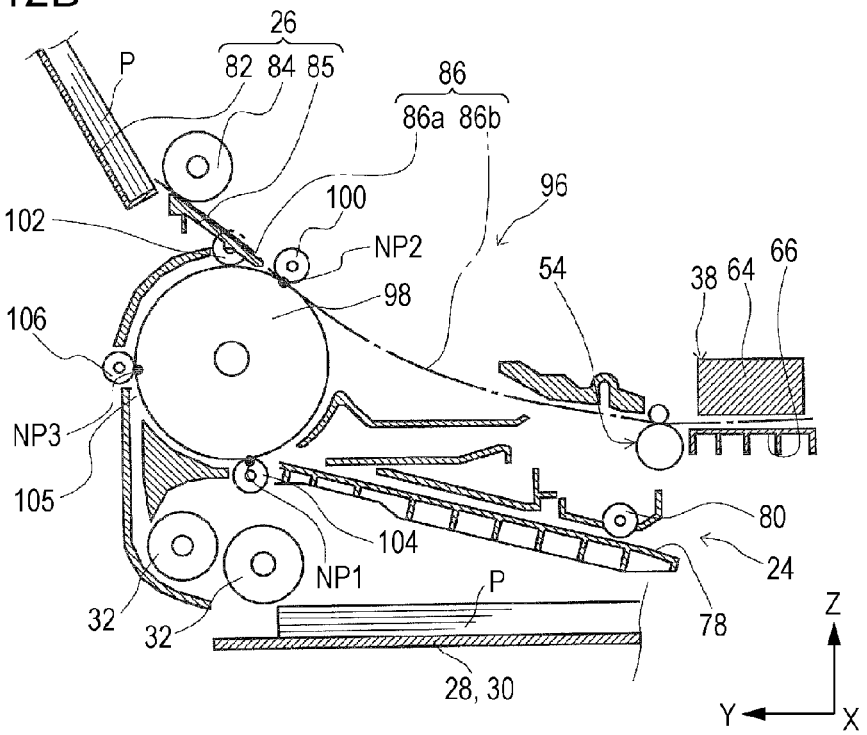
FIG. 12B is an outline view that shows a medium transport pathway from a back surface feeding unit in the second embodiment.
Figure 13A:
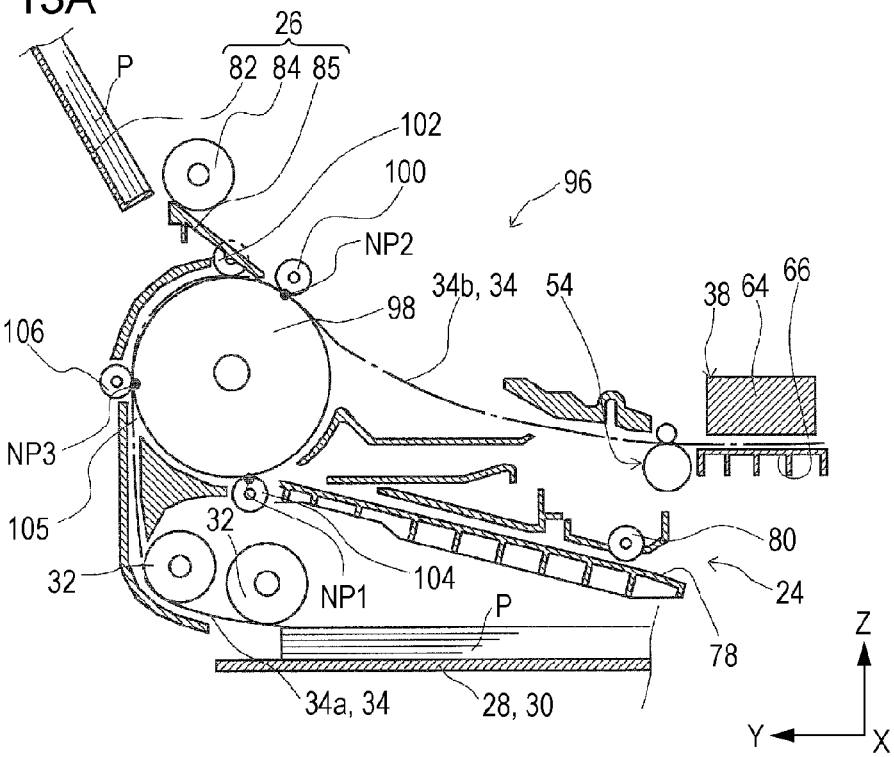
FIG. 13A is an outline view of a medium transport pathway from a medium accommodation unit in the second embodiment.
Figure 13B:
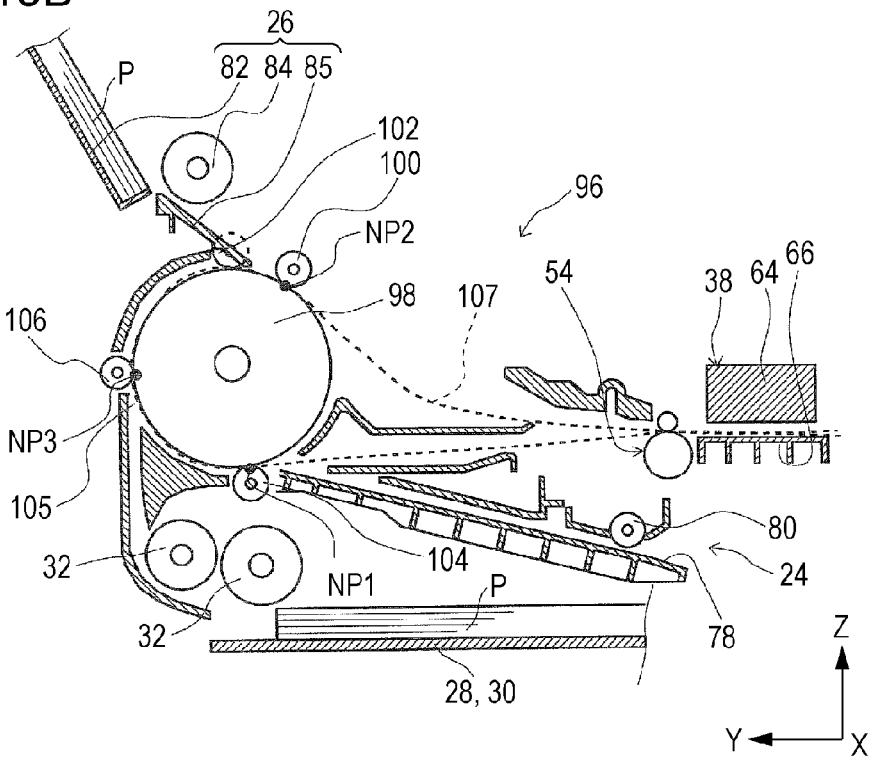
FIG. 13B is an outline view that shows a reverse transport pathway from the recording unit in the second embodiment.
Figure 14:
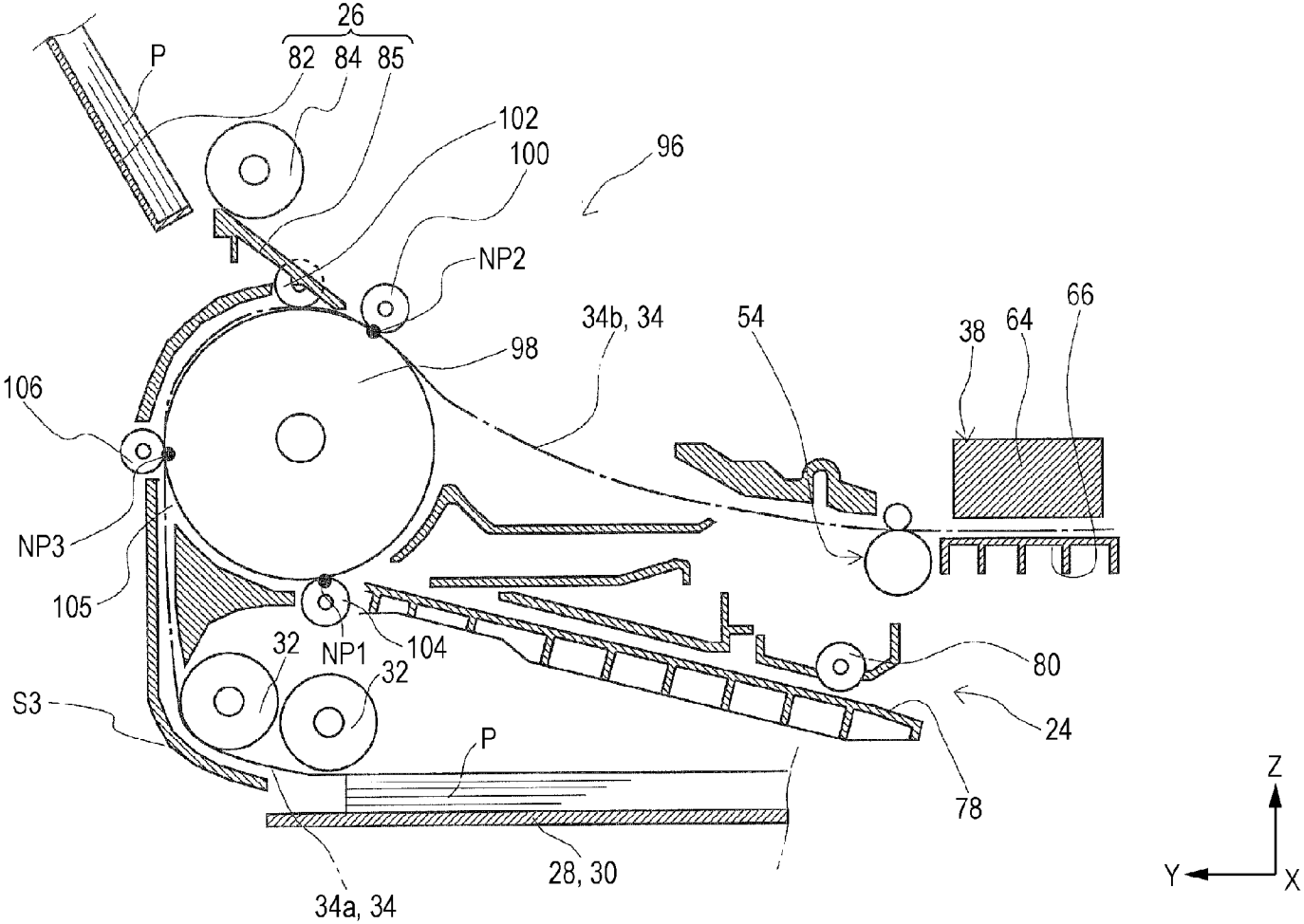
FIG. 14 is an outline view that shows a relationship between each medium transport pathway in the transport unit in the second embodiment.

FIG. 12A is a sectional side view that shows a medium transport pathway from a front surface manual insertion pathway in a second embodiment, FIG. 12B is an outline view that shows a medium transport pathway from a back surface feeding unit in the second embodiment, FIG. 13A is an outline view of a medium transport pathway from a medium accommodation unit in the second embodiment, FIG. 13B is an outline view that shows a reverse transport pathway from the recording unit in the second embodiment, and FIG. 14 is an outline view that shows a relationship between each medium transport pathway in the transport unit in the second embodiment.

Figure 15A:
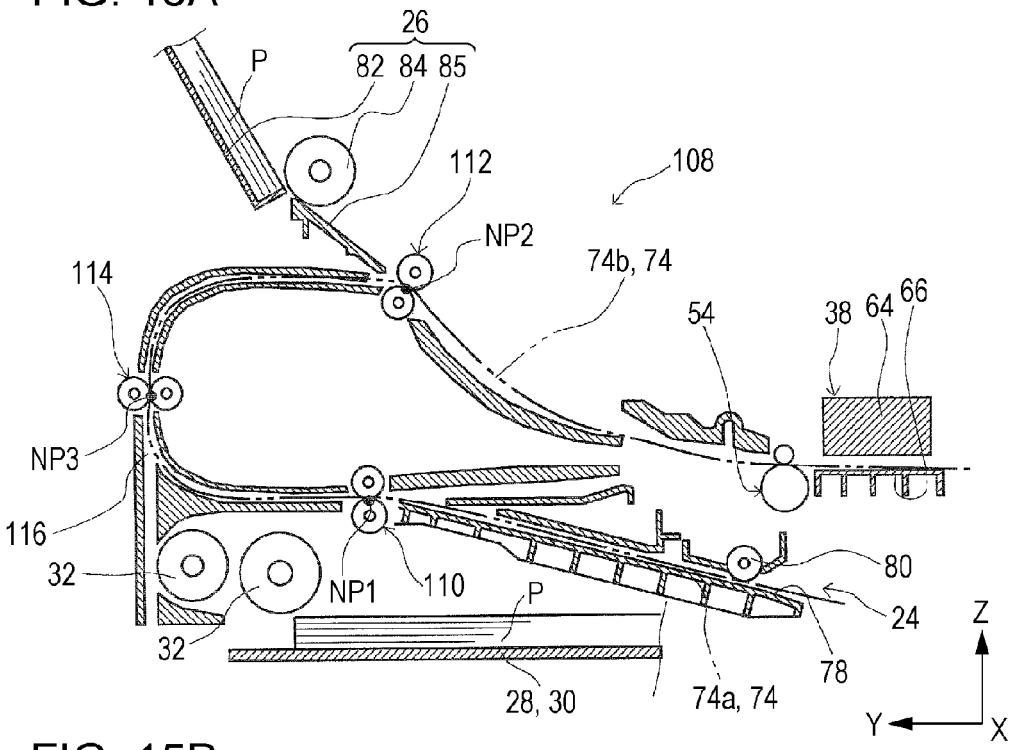
FIG. 15A is a sectional side view that shows a medium transport pathway from a front surface manual insertion pathway in a third embodiment.
Figure 15B:
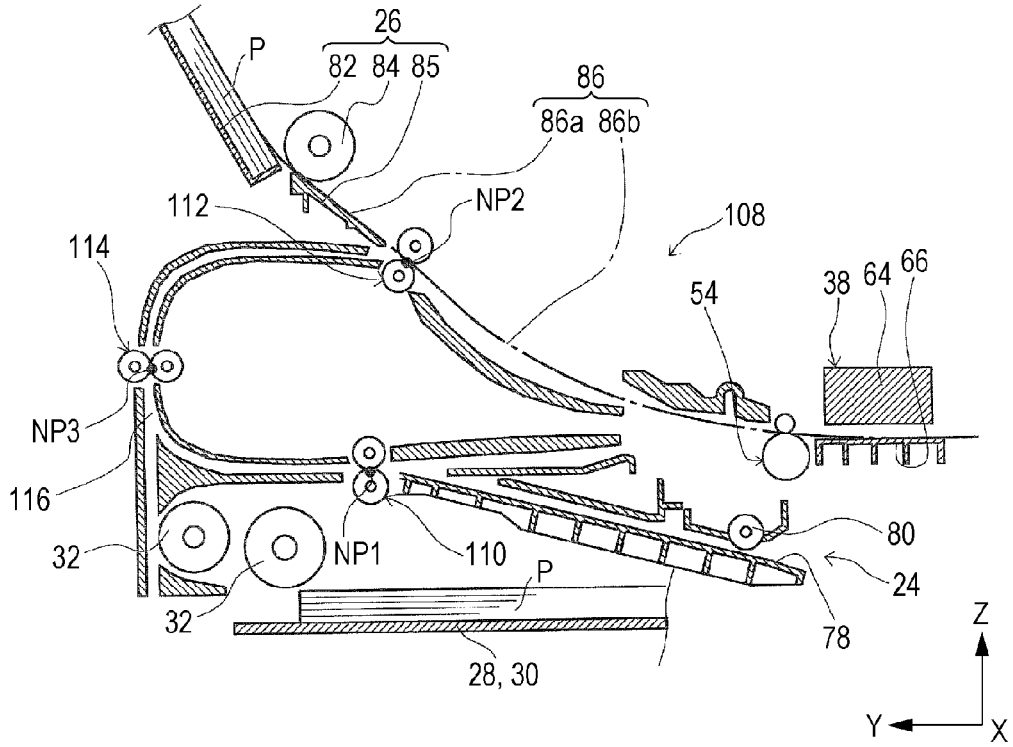
FIG. 15B is an outline view that shows a medium transport pathway from a back surface feeding unit in the third embodiment.
Figure 16A:
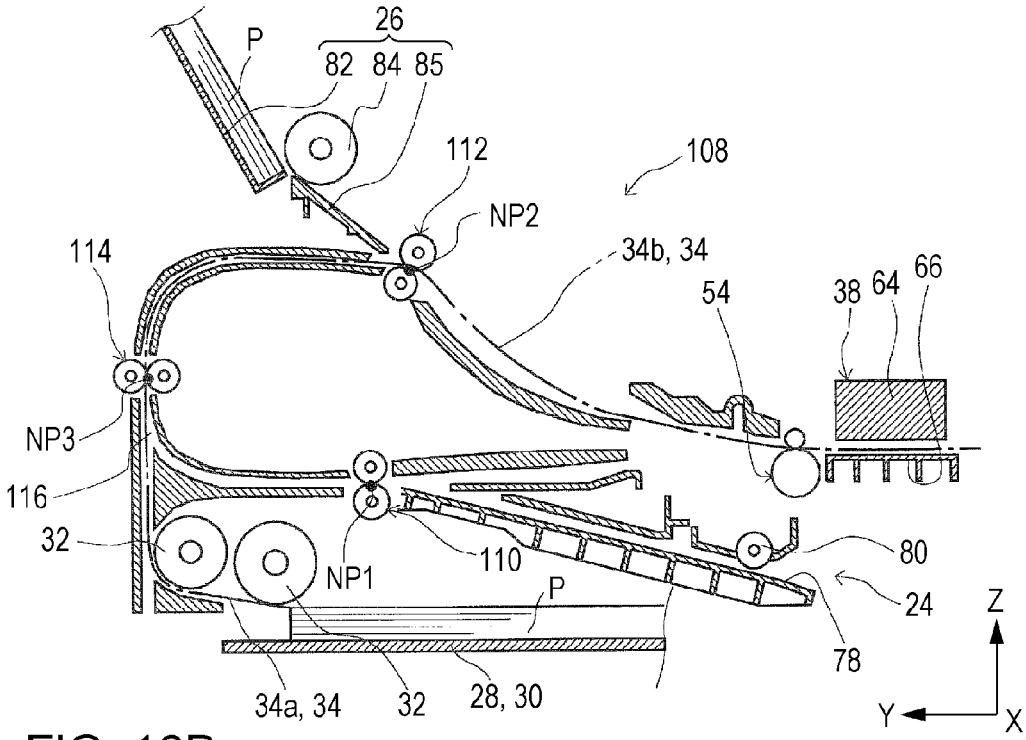
FIG. 16A is an outline view of a medium transport pathway from a medium accommodation unit in the third embodiment.
Figure 16B:
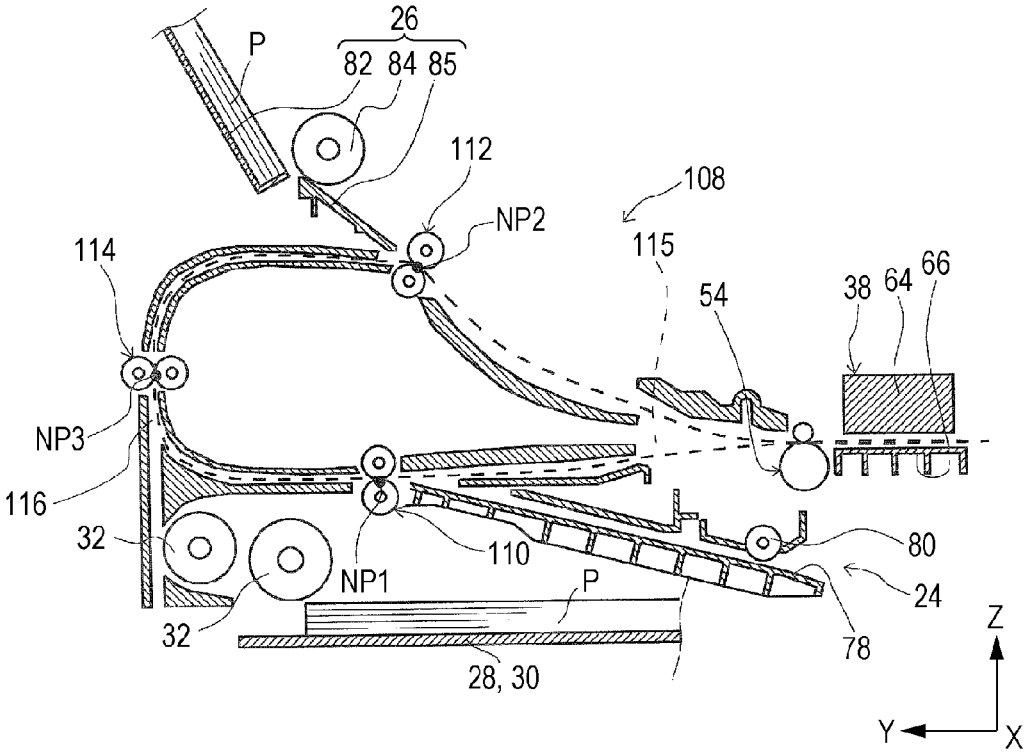
FIG. 16B is an outline view that shows a medium transport pathway in the transport unit in the third embodiment.

FIG. 15A is a sectional side view that shows a medium transport pathway from a front surface manual insertion pathway in a third embodiment, FIG. 15B is an outline view that shows a medium transport pathway from a back surface feeding unit in the third embodiment, FIG. 16A is an outline view of a medium transport pathway from a medium accommodation unit in the third embodiment, and FIG. 16B is an outline view that shows a medium transport pathway in the transport unit in the third embodiment.

In addition, in an X-Y-Z coordinate system that is shown in each drawing, the X direction shows a scanning direction of a recording head, the Y direction shows a depth direction of the recording apparatus, and the Z direction shows a direction of change in a distance (gap) between the recording head and a medium, that is, a device height direction. Additionally, in each drawing, a −Y direction is set as a recording apparatus front surface side and a side of a +Y direction is set as a recording apparatus back surface side.

Outline of Printer

The compositional elements of an ink jet printer 10 (hereinafter, referred to as a "printer 10") will be described as an example of a recording apparatus with reference to FIG. 1 and FIG. 2.

The printer 10 is provided with an apparatus main body 12 as a "medium transport device", and an image reading device 14. The apparatus main body 12 is provided with a housing 16, which configures the external appearance, an operation unit 18 that is provided on the front surface of the housing 16, and an opening unit 20 that is formed on the front surface side (the −Y axis direction in FIG. 1) of the apparatus main body 12.

The image reading device 14 is configured to be openable and closable with respect to an upper portion of the apparatus main body 12 with the back surface side of the apparatus main body 12 (a side in the +Y axis direction in FIG. 1) as a support point of the rotation axis thereof. In addition, the operation unit 18 is configured to be provided with a power button for operating the printer 10, printing settings buttons, a display panel and the like.

In addition, a discharge unit 22 from inside the apparatus main body 12 of sheets P (refer to FIGS. 2 to 4) as "media" upon which a recording process has been executed, and a front surface manual insertion unit 24 as a "third supply unit", which supplies sheets P to the inside of the apparatus main body 12 from the front surface side of the apparatus main body 12, are provided in the opening unit 20 on the front surface side of the apparatus main body 12. In addition, a back surface feeding unit 26 as a "second supply unit" is provided in an upper portion of the back surface side (the side in the +Y axis direction in FIG. 1) of the apparatus main body 12. In addition, as shown in FIG. 2, a medium accommodation unit 28 as a "first supply unit", which is positioned on a lower side in the Z axis direction of the apparatus main body 12, is provided in the printer 10. The front surface manual insertion unit 24 and the back surface feeding unit 26 will be described later.

Medium Accommodation Unit and Medium Transport Pathway from Medium Accommodation Unit Each configuration in the printer 10 and a transport pathway of sheets P from the medium accommodation unit 28 will be described with reference to FIGS. 2 to 4.

The medium accommodation unit 28 is provided with a paper supply cassette 30. The paper supply cassette 30 is configured to be capable of being mounted to and removed from a front side (a side in the −Y direction in FIG. 2) of the apparatus main body 12. Feeding rollers 32 and 32 that are rotatably driven by a driving source that is not shown in the drawings are provided above the paper supply cassette 30. Furthermore, in addition to supporting sheets P, a bottom plate 30*a* of the paper supply cassette 30 is configured as a hopper that biases the sheets P against the feeding roller 32 that is positioned in the +Z axis direction in FIG. 2.

In addition, in FIGS. 2 and 3, a chain line, to which the numeral 34 is given, shows a medium transport pathway 34 of sheets P that are transported from the medium accommodation unit 28. Additionally, in the present embodiment, the medium transport pathway 34 is provided with a medium supply pathway 34*a* from the medium accommodation unit 28 to a transport unit 36, and a medium transport pathway 34*b* that reaches the discharge unit 22 by passing at least a portion of a medium transport pathway 55 in the transport unit 36 that will be described later.

When sheets P that are accommodated in the paper supply cassette 30 are fed to a downstream side of the medium transport pathway 34, the feeding rollers 32 deliver the topmost sheet P along the medium supply pathway 34*a* from the paper supply cassette 30 to the transport unit 36 by coming into contact with the topmost sheet P of sheets P that are accommodated in the paper supply cassette 30 and rotating. Further, in FIG. 2, a sheet P that is delivered along the medium supply pathway 34*a* from the medium accommodation unit 28 by the feeding rollers 32 is transported along the medium transport pathway 34*b*, and reaches the discharge unit 22 via at least a portion of the medium transport pathway 55 in the transport unit 36 that will be described later and a recording unit 38.

In the present embodiment, the transport unit 36 is provided with a first roller 40 and a second roller 42 as the "transport rollers", a first transport driven roller 44, a second transport driven roller 46, a third transport driven roller 48, a fourth transport driven roller 50 and a fifth transport driven roller 52 as the "driven rollers", a pair of transport rollers 54 as the "reverse transport unit", and a bent portion 57 that inverts sheets P that are reverse transported in a reverse transport pathway 72 that will be described later by the pair of transport rollers 54 using the outer peripheral surface of the first roller 40. In addition, the first roller 40 and the second roller 42 are configured as a unit body 56 that is attachable and detachable with respect to the apparatus main body 12.

Additionally, when a back surface cover 58 is rotated in the +Y axis direction in FIG. 2 with respect to the apparatus main body 12 with a rotation axis 60 (refer to FIG. 2) as the rotational support point thereof, and the back surface cover 58 is put in an open state (not shown in the drawings) with respect to the apparatus main body 12, it is possible to attach and detach the unit body 56 with respect to the apparatus main body 12 from a side in the +Y axis direction in FIG. 2. In addition, in the present embodiment, when the unit body 56 is fixed to the apparatus main body 12, and the back surface cover 58 is in a closed state with respect to the apparatus main body 12, the first roller 40 and the second roller 42 are respectively rotatably driven in the clockwise direction in FIG. 2 by a common driving source that is not shown in the drawings.

As shown in FIGS. 2 and 3, the sheets P are transported along the medium transport pathway 34 in the transport unit 36 to the pair of transport rollers 54 via the fifth transport driven roller 52 and the third transport driven roller 48 that abut against the first roller 40, and the second transport driven roller 46 and the first transport driven roller 44 that abut against the second roller 42. The recording unit 38 is provided on the downstream side of the medium transport pathway 34 of the pair of transport rollers 54 of the transport unit 36.

Additionally, in FIG. 4, a chain line, to which the numeral 55 is given, shows a medium transport pathway 55 in the transport unit 36. In this instance, the medium transport pathway 55 in the transport unit 36 refers to a transport pathway of the sheets P from a nipping point NP1 with the fourth transport driven roller 50 that abuts against the second roller 42 that passes a nipping point NP3 between the first roller 40 and the fifth transport driven roller 52, and reaches a nipping point NP2 with the first transport driven roller 44 that abuts against the second roller 42.

The recording unit 38 is provided with a carriage 62 that is capable of moving in a scanning direction (the X axis direction in FIG. 2), a recording head 64 that is provided in a lower portion of the carriage 62 and ejects ink onto sheets P, and a platen 66 that is opposite to the recording head 64 and is provided so as to support the sheets P.

Furthermore, the discharge unit 22 is provided on the downstream side in the medium transport pathway 34 of the recording unit 38. A pair of discharge rollers 68 are provided in the discharge unit 22. Recording is executed on a first surface (a front surface) of sheets P that are sent along the medium transport pathway 34 from the transport unit 36 to the recording unit 38. After the execution of recording, the sheets P are nipped by the discharge rollers 68, and discharged from the opening unit 20 that is provided on the front surface side of the apparatus main body 12 toward a discharge stacker 70 that is provided on an apparatus front side. The discharge stacker 70 supports the discharged sheets P.

Reverse Transport Pathway

In this instance, in FIG. 5, a broken line, to which the numeral 72 is given, shows the reverse transport pathway 72 of sheets P that are reverse transported from the recording head 64. Next, the reverse transport pathway 72 will be described. In a case of performing recording on both sides of a sheet P in the printer 10, after recording has been performed on the first surface of the sheet P using the recording unit 38, a side of the sheet P that was a sheet trailing end when recording on the first surface was executed becomes a leading end due to a reverse transport action of the pair of transport rollers 54 and the discharge rollers 68, and the sheet P is sent to the reverse transport pathway 72 that is positioned on a side in the −Z direction of the second roller 42 in the Z axis direction (positioned below the unit body 56).

The reverse transport pathway 72 is provided along the bottom of the first roller 40 and the second roller 42 (the −Z direction in FIG. 5), and is provided so as to converge with the medium transport pathway 34 (refer to the chain line in FIG. 2) of the sheets P from the medium accommodation unit 28.

More specifically, the sheets P are transported along the medium transport pathway 55 (refer to FIG. 4) of the transport unit 36 in the reverse transport pathway 72 to the first roller 40, inverted by the bent portion 57, delivered to the recording unit 38 again using the second roller 42, and recording on the second surface is executed. Further, after recording has been executed, the sheets P are nipped by the discharge rollers 68, and discharged to the discharge stacker 70 that is provided on the apparatus front side.

Front Surface Manual Insertion Unit

Next, the front surface manual insertion unit 24 will be described with reference to FIGS. 6 and 7.

In the printer 10, the front surface manual insertion unit 24 is configured as a medium transport pathway that supplies sheets P one sheet at a time from the front side (the side in the −Y axis direction in FIGS. 6 and 7) of the apparatus main body 12 to the recording unit 38 by passing at least a portion of the medium transport pathway 55 of the transport unit 36. In FIGS. 6 and 7, a chain line, to which the numeral 74 is given, shows a medium transport pathway 74 in the front surface manual insertion unit 24. Additionally, in the present embodiment, the medium transport pathway 74 is provided with a medium supply pathway 74*a* from the front surface manual insertion unit 24 to the transport unit 36, and a medium transport pathway 74*b* that reaches the discharge unit 22 by passing through at least a portion of a medium transport pathway 55 in the transport unit 36.

The front surface manual insertion unit 24 is provided with a front surface medium support unit 76, a guide member 78 that is positioned on a side in the −Z axis direction of the recording unit 38 in FIG. 6, and a feeding roller 80. The front surface medium support unit 76 functions as a paper supply tray when sheets P are transported from the front side (the side of the −Y axis direction in FIG. 6) of the printer 10 to the transport unit 36. In addition, when the sheets P are discharged to the discharge stacker 70, at least a portion of the front surface medium support unit 76 supports the sheets P with the discharge stacker 70.

In FIG. 6, if a sheet P is inserted into the guide member 78 from the front surface medium support unit 76 in the front surface manual insertion unit 24, the feeding roller 80 transports the sheet P along the medium supply pathway 74*a* (refer to the chain line in FIG. 5) toward the transport unit 36. That is, the front surface manual insertion unit 24 is configured as a supply unit that supplies sheets P from a side of the discharge direction of sheets P with respect to the apparatus main body 12 using manual insertion.

Sheets P that are transported along the medium supply pathway 74*a* from the front surface manual insertion unit 24 are transported toward an abutment position of the second roller 42 and the fourth transport driven roller 50 in the transport unit 36, that is, the nipping point NP1 (refer to FIG. 7). Further, the medium supply pathway 74*a* and by extension, the medium transport pathway 74 converges with the reverse transport pathway 72 (refer to the broken line in FIG. 5) of sheets P that are reverse transported from the recording head 64 via the pair of transport rollers 54 at the nipping point NP1 between the second roller 42 and the fourth transport driven roller 50 in the transport unit 36, or at a position that is further on a recording unit 38 side than the nipping point NP1. In the present embodiment, a convergence position of the medium supply pathway 74*a* and the reverse transport pathway 72 is set as the nipping point NP1 between the second roller 42 and the fourth transport driven roller 50. In other words, the convergence position of the medium supply pathway 74*a* and the reverse transport pathway 72 is set to a position that is furthest away from the recording unit 38 in the medium transport pathway 55 using the bent portion 57.

Further, the sheets P are transported from the nipping point NP1 (refer to FIG. 7) between the second roller 42 and the fourth transport driven roller 50 in the transport unit 36 along the medium transport pathway 55 (refer to FIG. 4) in the transport unit 36 so as to reach the recording unit 38 by passing the fifth transport driven roller 52 and the third transport driven roller 48 that abut against the first roller 40, the second transport driven roller 46 and the first transport driven roller 44 that abut against the second roller 42 and the pair of transport rollers 54.

That is, the sheets P are transported from the front surface manual insertion unit 24 along the medium supply pathway 74*a* to the nipping point NP1 (refer to FIG. 7), and are transported along the medium transport pathway 74*b* by passing the nipping point NP1, and reach the discharge unit 22 by passing the recording unit 38. Back Surface Feeding Unit Next, the back surface feeding unit 26 will be described with reference to FIGS. 8 and 9.

In the printer 10, as shown in FIG. 8, the back surface feeding unit 26 is positioned in an upper portion of a back surface side (the side of the −Y axis direction in FIG. 6) of the apparatus main body 12. The back surface feeding unit 26 is provided with a back surface medium support unit 82, a feeding roller 84 and a guide member 85.

The back surface medium support unit 82 supports sheets P in a state of being inclined toward a back surface side (the side of the +Y axis direction in FIG. 8) of the apparatus main body 12 in FIG. 8. In addition to supporting the sheets P, a mounting surface 82*a* of the back surface medium support unit 82 is configured as a hopper that biases the sheets P toward the feeding roller 84 that is positioned opposite to the side of the −Y axis direction of the back surface medium support unit 82 in FIG. 8.

In this instance, a rear end portion of the back surface medium support unit 82 in the back surface feeding unit 26 is positioned further forward than a position of a back surface side of the housing 16 of the apparatus main body 12. In other words, the back surface feeding unit 26 is positioned further forward than a rear end of the apparatus main body 12. Therefore, since at least a portion of a region in which the back surface feeding unit 26 is provided and a region in which the transport unit 36 is provided overlap in the front/rear direction (the Y axis direction in FIG. 8) of the printer 10, it is possible to suppress the size of the printer 10 in the front/rear direction (the Y axis direction in FIG. 8).

In FIGS. 8 and 9, a chain line, to which the numeral 86 is given, shows a medium transport pathway 86 in the back surface feeding unit 26. Additionally, in the present embodiment, the medium transport pathway 86 is provided with the medium supply pathway 86*a* from the back surface feeding unit 26 to the transport unit 36, and a medium transport pathway 86*b* that reaches the discharge unit 22 by passing at least a portion of a medium transport pathway 55 in the transport unit 36. When the mounting surface 82*a* of the back surface medium support unit 82 is hopped up toward the feeding roller 84, the feeding roller 84 delivers a topmost sheet P from the back surface medium support unit 82 along the medium supply pathway 86*a* and the guide member 85 to the transport unit 36 by coming into contact with the topmost sheet P that is supported by the mounting surface 82*a* and rotating.

Sheets P that are delivered using the feeding roller 84 are transported along the medium supply pathway 86*a* and the guide member 85 toward an abutment position of the second roller 42 and the first transport driven roller 44 in the transport unit 36, that is, the nipping point NP2 (refer to FIG. 9). Further, the medium supply pathway 86*a* and by extension, the medium transport pathway 86 converges with the medium transport pathway 34 from the medium accommodation unit 28 at the nipping point NP2 between the second roller 42 and the first transport driven roller 44 in the transport unit 36, or at a position that is further on an upstream side in the transport direction of the sheets P than the nipping point NP2. In the present embodiment, a convergence position of the medium transport pathway 86 and the medium transport pathway 34 is set as the nipping point NP2 between the second roller 42 and the first transport driven roller 44. In the present embodiment, the nipping point NP2 is positioned further downstream than the bent portion 57 in the medium transport pathway 55, and is set to a convergence position that is closest to the recording unit 38.

In addition, as shown in FIG. 4, the medium transport pathway 86 that reaches the recording unit 38 from the back surface medium support unit 82 via the nipping point NP2 between the second roller 42 and the first transport driven roller 44 is configured to be substantially linear without a flexed portion that has a diameter dimension that is smaller than the diameters of the first roller 40 and the second roller 42.

In addition, since the medium transport pathway 86 reaches the recording unit 38 by passing the nipping point NP2 only, it is possible to make the pathway length of the medium transport pathway 86 shorter. Therefore, in the medium transport pathway 86 that reaches the recording unit 38 from the back surface feeding unit 26, when transporting specialty paper such as a medium with high rigidity or a medium in which it is not desirable to bend the paper surface, for example, a photograph or the like, it is possible to suppress a concern that the specialty paper will be bent or that marks will be left on a recording surface of the specialty paper as a result of nipping by the transport rollers.

Furthermore, since the sheets P that are transported in the medium transport pathway 86 are nipped by the second roller 42 and the first transport driven roller 44 only in a pathway from the back surface feeding unit 26 to the recording unit 38, it is possible to reduce the number of times that the sheets P are nipped by the transport rollers, and therefore, it is possible to suppress a concern that marks will be left on a recording surface of the sheets P as a result of nipping by the transport rollers.

Relationship of Each Medium Transport Pathway with Transport Unit

In this instance, the relationships of the medium transport pathway 74 (refer to FIG. 7) from the front surface manual insertion unit 24 (the third supply unit), the medium transport pathway 86 (refer to FIG. 9) from the back surface feeding unit 26 (the second supply unit), and the medium transport pathway 34 (refer to FIG. 3) from the medium accommodation unit 28 (the first supply unit) in the transport unit 36 will be described in order with reference to FIG. 10.

In FIG. 10, a straight line, to which the numeral S1 is given, shows a tangent line S1 at the nipping point NP1 between the second roller 42 and the fourth transport driven roller 50. In the present embodiment, the tangent line S1 extends in the Y axis direction, that is, horizontally. Further, the guide member 78, or in other words, the medium supply pathway 74*a* (refer to FIG. 7) is inclined with respect to the tangent line S1 by an angle θ1.

In addition, when a straight line that connects a nipping point NP4 of the pair of transport rollers 54 and the nipping point NP1 is set as S4, an angle between the tangent line S1 and the straight line S4 is θ2. In the present embodiment, since the absolute value of the angle θ2 is small, that is, since it is substantially horizontal, when a sheet P is transported from the pair of transport rollers 54 along the reverse transport pathway 72 (refer to FIG. 5) toward the nipping point NP1, a leading end of the sheet P that is reverse transported can smoothly enter between the second roller 42 and the fourth transport driven roller 50, and it is possible to transport the sheet P smoothly. That is, it is not necessary to provide a guide member such as a flap for smooth entry.

In addition, a tangent line S2 that is common to the second roller 42 and the first transport driven roller 44 at the nipping point NP2 between the second roller 42 and the first transport driven roller 44 is inclined from the back surface feeding unit 26 toward a side of the recording head 64. Additionally, in the present embodiment, a guide surface of the sheets P of the guide member 85 is configured as a surface along the tangent line S2.

Further, in FIG. 10, the tangent line S2 is inclined with respect to the Y axis direction (the horizontal direction) by an angle θ3. In this instance, since the transport direction of the sheets P that are transported from the back surface feeding unit 26 along the guide member 85, that is, the transport direction of the medium supply pathway 86*a*, and a direction of the tangent line S2 substantially coincide with one another, it is possible to transport the sheets P smoothly at the nipping point NP2.

In addition, it is possible to set the angle of inclination θ1 of the medium supply pathway 74*a* to be smaller than the angle of inclination θ3 of the medium supply pathway 86*a*. As a result of this, since it is possible to suppress the height of the front surface manual insertion unit 24 in the apparatus height direction (the Z axis direction in FIG. 10), it is possible to suppress an increase in size in the height direction (the Z axis direction in FIG. 10) of the printer 10. In addition, it is possible to transport the sheets P smoothly at the nipping point NP1.

In addition, in FIG. 10, an abutment position between the first roller 40 and the fifth transport driven roller 52, that is, the nipping point NP3 is set as a convergence position of the medium transport pathway 34 from the medium accommodation unit 28 in the transport unit 36. In this instance, as shown in FIG. 10, a tangent line S3 that is common to the first roller 40 and the fifth transport driven roller 52 at the nipping point NP3 between the first roller 40 and the fifth transport driven roller 52 extends in the height direction (that Z axis direction in FIG. 10) of the apparatus main body 12, that is, in a substantially vertical manner.

Therefore, since the transport direction of the sheets P that are transported from the medium accommodation unit 28 and a direction of the tangent line S3 substantially coincide with one another, it is possible to transport the sheets P smoothly at the nipping point NP3. In addition, the nipping point NP3, which is a convergence position of the medium transport pathway 34 from the medium accommodation unit 28 in the transport unit 36 is positioned along the transport direction of the sheets P in the transport unit 36 at the bent portion 57 between the nipping point NP1 and the nipping point NP2.

In the present embodiment, in FIG. 10, the transport unit 36 is provided with the first roller 40 and the second roller 42 that are positioned at an interval in the Y axis direction. Further, the nipping point NP1, which is a convergence position of the medium transport pathway 74 from the front surface manual insertion unit 24, and the nipping point NP2, which is a convergence position of the medium transport pathway 86 from the back surface feeding unit 26 are formed on the second roller 42. In addition, the nipping point NP1 also doubles as a convergence position of the reverse transport pathway 72 of the sheets P that are reverse transported from the pair of transport rollers 54.

Therefore, since the sheets P that are reverse transported from the pair of transport rollers 54 reach the recording unit 38 from the nipping point NP1 via the nipping point NP3 and the nipping point NP2, it is possible to make the pathway length of the reverse transport pathway 72 longer. In addition, by adjusting an interval between the first roller 40 and the second roller 42, it is possible to make the pathway length of the reverse transport pathway 72 longer. As a result of this, it is possible to make the pathway length of the reverse transport pathway 72 longer without increasing the diameter of the first roller 40 and the second roller 42, and therefore, it is possible to suppress an increase in the size in the height direction of the printer 10. Additionally, in the present embodiment, the interval is set to be smaller than the minimum length in a transport pathway direction of a sheet P that the printer 10 can handle.

In addition, in the present embodiment, the first roller 40 and the second roller 42 are set to have the same diameter dimension. Therefore, it is possible to configure the first roller 40 and the second roller 42 with a common member, and therefore, it is possible to achieve a reduction in cost. In addition, since the diameters of the first roller 40 and the second roller 42 are the same, it is possible to easily make the circumferential speeds of the outer peripheries of the rollers, that is, the sheet transport speeds, uniform by making the number of rotations of both rollers the same.

In addition, since it is possible to make the sheet transport speeds uniform in the first roller 40 and the second roller 42, a circumstance in which a pulling force is applied to the sheets P between the first roller 40 and the second roller 42 and a circumstance in which the sheets P become curved are avoided. As a result of this, it is possible to favorably transport the sheets P along the transport pathway.

In addition, in the present embodiment, since the first roller 40 and the second roller 42 are provided in positions that overlap one another in the height direction of the printer 10, it is possible to suppress the dimensions of a disposition range of the first roller 40 and the second roller 42 in the height direction of the printer 10 to a minimum.

In the present embodiment, since the transport pathways of sheets P that are supplied from the front surface manual insertion unit 24, the back surface feeding unit 26 and the medium accommodation unit 28 in the transport unit 36 respectively converge at the nipping point NP1, the nipping point NP2 and the nipping point NP3, which are different convergence positions, and the reverse transport pathway 72 from the pair of transport rollers 54 also converges with the transport unit 36 by passing either one of the nipping point NP1, the nipping point NP2 and the nipping point NP3, it is possible to make each medium transport pathway common as the medium transport pathway 55 (refer to FIG. 4) in the transport unit 36. Therefore, since it is possible to respectively set each transport pathway 34, 74 and 86 from the front surface manual insertion unit 24, the back surface feeding unit 26 and the medium accommodation unit 28 as the single medium transport pathway 55, it is possible to simplify the configuration of the transport unit 36. As a result of this, it is possible to reduce the amount of space that the transport unit 36 occupies in the printer 10.

In addition, by respectively setting the medium supply pathways 34*a*, 74*a* and 86*a* from the front surface manual insertion unit 24, the back surface feeding unit 26 and the medium accommodation unit 28 to have different convergence positions, it is possible to perform the transport of a variety of sheets P that are supplied from the front surface manual insertion unit 24, the back surface feeding unit 26 and the medium accommodation unit 28, the length in the transport direction and the rigidity of which differ, with convergence positions that are respectively appropriate for the sheets P. As a result of this, it is possible to execute processing of a wide variety of sheets P in the printer 10, and therefore, it is possible to improve the usability of the printer 10.

In addition, in the present embodiment, the medium supply pathway 34*a* from the medium accommodation unit 28 is configured to converge with the medium transport pathway 55 by passing the nipping point NP3 that is positioned at the bent portion 57 between the nipping point NP1 and the nipping point NP2. In this instance, by converging with the medium transport pathway 55 at the nipping point NP3, a transport direction of sheets P that are supplied from the medium accommodation unit 28 is changed along the bent portion 57. As a result of this, the sheets P are smoothly transported along the medium transport pathway 55 toward the recording unit 38. Therefore, since the transport direction of the sheets P that are supplied from the medium accommodation unit 28 is changed along the bent portion 57 from the nipping point NP3, it is possible to smoothly transport the sheets P toward the recording unit 38.

In addition, in the present embodiment, since the medium accommodation unit 28 is configured as a paper supply cassette, the frequency of use of the medium supply pathway 34*a* from the medium accommodation unit 28 is the highest. In the present embodiment, in the medium transport pathway 34 in which the frequency of use is highest, it is possible to make the convergence from the medium supply pathway 34*a* from the medium accommodation unit 28 to the medium transport pathway 55 smooth, and therefore, it is possible to change the transport direction of the sheets P that are transported smoothly. Therefore, it is possible to suppress circumstances in which paper jams and transport defects are caused in the medium transport pathway 34 of the sheets P from the medium accommodation unit 28 to the recording unit 38.

Modification Example of First Embodiment

Next, a modification example of the first embodiment will be described with reference to FIG. 11.

The modification from the first embodiment is that a plurality of expanded medium accommodation units 88, 88 and 88 are further provided below the medium accommodation unit 28.

As shown in FIG. 11, in a printer 90, it is possible to further provide a plurality of expanded medium accommodation units 88, 88 and 88 below the medium accommodation unit 28 that is provided in a lower portion of the apparatus main body 12. The expanded medium accommodation units 88 have substantially the same configuration as the medium accommodation unit 28. The expanded medium accommodation units 88 are provided with a paper supply cassette 30 and feeding rollers 32 and 32. In addition, in the expanded medium accommodation units 88, a pair of feeding rollers 92 is provided on a downstream side of the feeding rollers 32 and 32 in the transport direction of sheets P.

In addition, in FIG. 11, chain lines, to which the numeral 94 are given, show medium transport pathways 94 of sheets P that are transported from the expanded medium accommodation units 88, 88 and 88. Additionally, in the present embodiment, the medium transport pathways 94 are provided with medium supply pathways 94*a* from each expanded medium accommodation unit 88 to the transport unit 36, and a medium transport pathway 94*b* that reaches the discharge unit 22 by passing at least a portion of a medium transport pathway 55 in the transport unit 36.

When sheets P that are accommodated in the paper supply cassette 30 are fed to a downstream side of the medium transport pathway 94, the feeding rollers 32 deliver the topmost sheet P along the medium supply pathway 94*a* from the paper supply cassette 30 to the transport unit 36 by coming into contact with the topmost sheet P of sheets P that are accommodated in the paper supply cassette 30 and rotating.

In the expanded medium accommodation units 88, sheets P that are delivered by the feeding rollers 32 are delivered toward the nipping point NP3 between the first roller 40 and the fifth transport driven roller 52 in the apparatus main body 12 that is positioned above the expanded medium accommodation units 88 using the pair of feeding rollers 92. Additionally, in the present modification example, since the transport direction of the sheets P that are transported from the expanded medium accommodation units 88, 88 and 88 and a direction of the tangent line S3 substantially also coincide with one another, it is possible to transport the sheets P smoothly at the nipping point NP3.

Further, sheets P that are delivered to the transport unit 36 reach the discharge unit 22 by passing the recording unit 38 in the same manner as the medium transport pathway 34 from the medium accommodation unit 28. Additionally, in the present modification example, when performing recording on both surfaces of a sheet P on which recording has been performed by the recording unit 38, recording is also performed using the recording unit 38 again by inverting the sheet P along the reverse transport pathway 72 (refer to FIG. 5).

Second Embodiment

Next, a second embodiment will be described with reference to FIGS. 12A to 14.

The modification from the first embodiment is that, in a transport unit 96, a plurality of driven rollers abut against a single transport roller. Other configurations and effects are the same as those of the first embodiment.

The transport unit 96 is provided with a transport roller 98, a first transport driven roller 100, a second transport driven roller 102, a third transport driven roller 104, a fourth transport driven roller 106, a pair of transport rollers 54 and a bent portion 105.

As shown in FIG. 12A, the medium supply pathway 74*a* from the front surface manual insertion unit 24 (the third supply unit) converges with a medium transport pathway in the transport unit 96 by passing through a nipping point NP1, which is an abutment position between the transport roller 98 and the third transport driven roller 104. Further, the medium transport pathway 74*b* is configured to reach the recording unit 38 from the nipping point NP1 by passing the nipping point NP3 and the nipping point NP2.

In addition, as shown in FIG. 12B, the medium supply pathway 86*a* from the back surface feeding unit 26 (the second supply unit) converges with a medium transport pathway in the transport unit 96 by passing through a nipping point NP2, which is an abutment position between the transport roller 98 and the first transport driven roller 100. Further, the medium transport pathway 86*b* is configured to reach the recording unit 38 by passing the nipping point NP2 only.

Further, as shown in FIG. 13A, the medium supply pathway 34*a* from the medium accommodation unit 28 (the first supply unit) converges with a medium transport pathway in the transport unit 96 by passing through a nipping point NP3, which is an abutment position between the transport roller 98 and the fourth transport driven roller 106. Further, the medium transport pathway 34*b* is configured to reach the recording unit 38 from the nipping point NP3 by passing the nipping point NP2.

Additionally, the medium transport pathway in the transport unit 96 refers to a transport pathway of the sheets P from the nipping point NP1 with the third transport driven roller 104 that abuts against the transport roller 98 that passes the nipping point NP3 between the transport roller 98 and the fourth transport driven roller 106, and reaches the nipping point NP2 with the first transport driven roller 100 that abuts against the transport roller 98.

In addition, as shown in FIG. 13B, a reverse transport pathway 107 from the recording unit 38 is configured as a transport pathway from the pair of transport rollers 54 that reaches the recording unit 38 again by passing through the nipping point NP1 with the third transport driven roller 104 that abuts against the transport roller 98, the nipping point NP3 between the transport roller 98 and the fourth transport driven roller 106, or in other words, the bent portion 105, and the nipping point NP2 with the first transport driven roller 100 that abuts against the transport roller 98. Additionally, in the transport unit 96, the bent portion 105 in the medium transport pathway is configured to invert sheets P using the outer peripheral surface of the transport roller 98.

In a case in which a sheet P is supplied to the recording unit 38 from any one of the front surface manual insertion unit 24 (the third supply unit), the back surface feeding unit 26 (the second supply unit) and the medium accommodation unit 28 (the first supply unit), when recording on both surfaces of a sheet P is executed, recording on both surfaces of the sheet P is also executed by inverting the sheet P by passing the sheet P through the reverse transport pathway 107.

As shown in FIG. 14, in the present embodiment, the medium supply pathway 74*a* (refer to FIG. 12A) is also inclined with respect to a tangent line S1 at the nipping point NP1 between the transport roller 98 and the third transport driven roller 104 by an angle θ1.

In addition, when a straight line that connects a nipping point NP4 of the pair of transport rollers 54 and the nipping point NP1 is set as S4, an angle between the tangent line S1 and the straight line S4 is θ2. In the present embodiment, since the absolute value of the angle θ2 is also small, when a sheet P is transported from the pair of transport rollers 54 along the reverse transport pathway 107 (refer to FIG. 13B) toward the nipping point NP1, a leading end of the sheet P that is reverse transported can smoothly enter between the transport roller 98 and the third transport driven roller 104, and it is possible to transport the sheet P smoothly.

In addition, a tangent line S2 that is common to the transport roller 98 and the first transport driven roller 100 at the nipping point NP2 between the transport roller 98 and the first transport driven roller 100 is inclined from the back surface feeding unit 26 toward a side of the recording head 64. Additionally, in the present embodiment, a guide surface of the sheets P of the guide member 85 is also configured as a surface along the tangent line S2.

Further, in FIG. 14, the tangent line S2 is inclined with respect to the Y axis direction (the horizontal direction) by an angle θ3. In this instance, since the transport direction of the sheets P that are transported from the back surface feeding unit 26 along the guide member 85, that is, the transport direction of the medium supply pathway 86*a*, and a direction of the tangent line S2 substantially coincide with one another, it is possible to transport the sheets P smoothly at the nipping point NP2.

In addition, it is possible to set the angle of inclination θ1 of the medium supply pathway 74*a* to be smaller than the angle of inclination θ3 of the medium supply pathway 86*a*. As a result of this, since it is possible to suppress the height of the front surface manual insertion unit 24 in the apparatus height direction (the Z axis direction in FIG. 14), it is possible to suppress an increase in size in the height direction (the Z axis direction in FIG. 14) of the printer 10. In addition, it is possible to transport the sheets P smoothly at the nipping point NP1.

In the present embodiment, since the transport unit 96 is provided with a single transport roller 98 and the driven rollers 100, 104 and 106 that are positioned so as to nip sheets P with the transport roller 98 at at least the nipping point NP1, the nipping point NP2 and the nipping point NP3, it is possible to reliably nip the sheets P that are supplied from the front surface manual insertion unit 24, the back surface feeding unit 26 and the medium accommodation unit 28 at each of the convergence positions, and therefore, it is possible to make guiding of the sheets P to the medium transport pathways 34, 74 and 86 smooth.

In addition, in the present embodiment, since the medium transport pathway in the transport unit 96 is configured to use the outer peripheral surface of the transport roller 98, it is possible to modify the pathway length of the medium transport pathway in the transport unit 96 by modifying the diameter dimensions of the transport roller 98. In addition, since the transport roller is configured by a single roller, it is possible to reduce the number of components, and therefore, it is possible to achieve a reduction in cost.

In addition, in the present embodiment, since, in the transport unit 96, the transport pathways of sheets P that are supplied from the front surface manual insertion unit 24, the back surface feeding unit 26 and the medium accommodation unit 28 also respectively converge at the nipping points NP1, NP2 and NP3 in the transport unit 96, which are different convergence positions, and the reverse transport pathway 107 from the pair of transport rollers 54 also converges with the transport unit 96 by passing either one of the nipping points NP1, NP2 and NP3, it is possible to make the transport pathways common as a medium transport pathway in the transport unit 96. Therefore, since it is possible to set each transport pathway 34, 74 and 86 from the front surface manual insertion unit 24, the back surface feeding unit 26 and the medium accommodation unit 28 as a single transport pathway, it is possible to simplify the configuration of the transport unit 96. As a result of this, it is possible to reduce the amount of space that the transport unit 96 occupies in the printer 10.

In addition, by respectively setting the medium transport pathways 34, 74 and 86 from the front surface manual insertion unit 24, the back surface feeding unit 26 and the medium accommodation unit 28 to have different convergence positions, it is possible to perform the transport of a variety of sheets P that are supplied from the front surface manual insertion unit 24, the back surface feeding unit 26 and the medium accommodation unit 28, the length in the transport direction and the rigidity of which differ, with convergence positions that are respectively appropriate for the sheets P. As a result of this, it is possible to execute processing of a wide variety of sheets P in the printer 10, and therefore, it is possible to improve the usability of the printer 10.

Third Embodiment

Next, a third embodiment will be described with reference to FIGS. 15A to 16B.

The modification from the first embodiment is that, in a transport unit 108, a transport pathway of sheets P is configured by a plurality of pairs of transport rollers. The transport unit 108 is provided with a first pair of transport rollers 110, a second pair of transport rollers 112, a third pair of transport rollers 114, a pair of transport rollers 54 and a bent portion 116.

As shown in FIG. 15A, the medium supply pathway 74*a* from the front surface manual insertion unit 24 (the third supply unit) converges with a medium transport pathway in the transport unit 108 by passing through a nipping point NP1, which is an abutment position of the first pair of transport rollers 110. Further, the medium transport pathway 74*b* is configured to reach the recording unit 38 from the nipping point NP1 by passing the nipping point NP3 and the nipping point NP2.

In addition, as shown in FIG. 15B, the medium supply pathway 86*a* from the back surface feeding unit 26 (the second supply unit) converges with a medium transport pathway in the transport unit 108 by passing through a nipping point NP2, which is an abutment position of the second pair of transport rollers 112. Further, the medium transport pathway 86*b* is configured to reach the recording unit 38 by passing the nipping point NP2 only.

Further, as shown in FIG. 16A, the medium supply pathway 34*a* from the medium accommodation unit 28 (the first supply unit) converges with a medium transport pathway in the transport unit 108 by passing through a nipping point NP3, which is an abutment position of the third pair of transport rollers 114. Further, the medium transport pathway 34*b* is configured to reach the recording unit 38 from the nipping point NP3 by passing the nipping point NP2.

Additionally, the medium transport pathway in the transport unit 108 refers to a transport pathway of the sheets P from the nipping point NP1 of the first pair of transport rollers 110 that passes the nipping point NP3 of the third pair of transport rollers 114 and reaches the nipping point NP2 of the second pair of transport rollers 112.

In addition, as shown in FIG. 16B, a reverse transport pathway 115 from the recording unit 38 that reaches the recording unit 38 again by passing through the nipping point NP1, the nipping point NP3, the bent portion 116 and the nipping point NP2 is also set in the present embodiment. Additionally, in the transport unit 108, the bent portion 116 in the medium transport pathway is configured to invert sheets P by being positioned between the nipping point NP1 of the first pair of transport rollers 110 and the nipping point NP2 of the second pair of transport rollers 112.

In addition, in the present embodiment, although not shown in the drawings, since the tangent line S1 to tangent line S4 and angle θ1 to angle θ3 also have the same configuration as the first embodiment and the second embodiment, it is possible to obtain the same effects as the first embodiment and the second embodiment.

In the present embodiment, since the transport unit 108 is provided with the plurality of pairs of transport rollers 110, 112 and 114 that respectively form the nipping point NP1, the nipping point NP2 and the nipping point NP3 at the convergence position in the transport unit 108 from the front surface manual insertion unit 24, the convergence position in the transport unit 108 from the back surface feeding unit 26 and the convergence position in the transport unit 108 from the medium accommodation unit 28, it is possible to make the inverse pathway length of sheets P longer without increasing the diameter of the transport rollers, and therefore, it is possible to suppress an increase in the size in the height direction of the printer 10.

In addition, in the present embodiment, since, in the transport unit 108, the transport pathways of sheets P that are supplied from the front surface manual insertion unit 24, the back surface feeding unit 26 and the medium accommodation unit 28 also respectively converge at the nipping points NP1, NP2 and NP3 in the transport unit 108, which are different convergence positions, and the reverse transport pathway from the pair of transport rollers 54 also converges with the transport unit 108 by passing either one of the nipping points NP1, NP2 and NP3, it is possible to make the transport pathways common as a medium transport pathway in the transport unit 108. Therefore, since it is possible to set each transport pathway 34, 74 and 86 from the front surface manual insertion unit 24, the back surface feeding unit 26 and the medium accommodation unit 28 as a single transport pathway, it is possible to simplify the configuration of the transport unit 108. As a result of this, it is possible to reduce the amount of space that the transport unit 108 occupies in the printer 10.

In addition, by respectively setting the medium transport pathways 34, 74 and 86 from the front surface manual insertion unit 24, the back surface feeding unit 26 and the medium accommodation unit 28 to have different convergence positions, it is possible to perform the transport of a variety of sheets P that are supplied from the front surface manual insertion unit 24, the back surface feeding unit 26 and the medium accommodation unit 28, the length in the transport direction and the rigidity of which differ, with convergence positions that are respectively appropriate for the sheets P. As a result of this, it is possible to execute processing of a wide variety of sheets P in the printer 10, and therefore, it is possible to improve the usability of the printer 10.

Modification Examples of First to Third Embodiments (1) In each of the abovementioned embodiments, a configuration in which the convergence positions in the medium transport pathways 34, 74 and 86 from the front surface manual insertion unit 24, the back surface feeding unit 26 and the medium accommodation unit 28 were set as the nipping point NP1, the nipping point NP2 and the nipping point NP3, was adopted, but in place of this configuration, a configuration in which the convergence positions in the medium transport pathways 34, 74 and 86 from the front surface manual insertion unit 24, the back surface feeding unit 26 and the medium accommodation unit 28 are respectively provided on an upstream side of the nipping points NP1, NP2 and NP3 in the transport direction of the sheets P, may be used.

(2) In the present embodiment, a configuration in which the reverse transport pathway 72 from the pair of transport rollers 54 converges with the transport units 36, 96 and 108 at the nipping point NP1, which is the first convergence position, but in place of this configuration, a configuration in which the reverse transport pathway 72 converges with the transport units 36, 96 and 108 at the nipping point NP2, which is the second convergence position, or at the nipping point NP3, which is the third convergence position, may be used.

If the abovementioned descriptions are summarized, the apparatus main body 12 of the present embodiment is provided with the transport unit 36, 96 or 108 that includes the medium transport pathway 55, transports sheets P toward a side of the recording unit 38 that executes recording on the sheets P before the execution of recording, or transports sheets P that have been processed by the recording unit 38 toward the side of the recording unit 38 again by inverting the sheets P, the front surface manual insertion unit 24, the back surface feeding unit 26 and the medium accommodation unit 28 that supply the sheets P to the transport unit 36, 96 or 108 before the execution of recording, and the pair of transport rollers 54 that reverse transport the sheets P on which recording has been performed by the recording unit 38 from the recording unit 38 to the transport unit 36, 96 or 108 in order to invert the sheets P. Inside the medium transport pathways 34, 74 and 86, the transport unit 36, 96 or 108 has the same number of convergence positions NP1, NP2 and NP3 as the front surface manual insertion unit 24, the back surface feeding unit 26 and the medium accommodation unit 28. In the transport unit 36, 96 or 108, sheets P that are supplied from the front surface manual insertion unit 24, the back surface feeding unit 26 and the medium accommodation unit 28 respectively converge with the medium transport pathways in the transport unit 36, 96 or 108 at the different convergence positions NP1, NP2 and NP3. In addition, sheets P that are reverse transported from the pair of transport rollers 54 to the transport unit 36, 96 or 108 converge with the medium transport pathways in the transport unit 36, 96 or 108 by passing at least one of the plurality of convergence positions NP1, NP2 and NP3.

The apparatus main body 12 is provided with the front surface manual insertion unit 24, in which the transport unit 36, 96 or 108 is provided with a bent portion 57 that inverts sheets P that are reverse transported by the pair of transport rollers 54 in the medium transport pathway 55. The medium supply pathway 74*a* from the front surface manual insertion unit 24 converges with the reverse transport pathway 72 of sheets P that are reverse transported from the pair of transport rollers 54 to the transport unit 36, 96 or 108, and passes through the first convergence position NP1, which is a convergence position that is furthest away from the recording unit 38 in the medium transport pathway 55 that heads toward the recording unit 38 using the bent portion 57.

The apparatus main body 12 is provided with the back surface feeding unit 26. The medium supply pathway 86*a* from the back surface feeding unit 26 converges with the medium transport pathway 55 in the transport unit 36, 96 or 108 by passing the second convergence position NP2, which is a convergence position that is positioned further downstream in the medium transport pathway 55 that heads toward the recording unit 38 than the bent portion 57 and is closest to the recording unit 38.

The apparatus main body 12 is provided with the medium accommodation unit 28. The medium supply pathway 34*a* from the medium accommodation unit 28 converges with a medium transport pathway in the transport unit 36, 96 or 108 by passing the third convergence position NP3 that is positioned in the medium transport pathway 55 that heads toward the recording unit 38 at the bent portion 57 between the first convergence position NP1 and the second convergence position NP2.

Sheets P that are supplied from the front surface manual insertion unit 24 are transported to the recording unit 38 by passing the first convergence position NP1, the third convergence position NP3 and the second convergence position NP2. Sheets P that are supplied from the back surface feeding unit 26 are transported to the recording unit 38 by passing the second convergence position NP2 only. Sheets P that are supplied from the medium accommodation unit 28 are transported to the recording unit 38 by passing the third convergence position NP3 and the second convergence position NP2.

The transport unit 96 is provided with a single transport roller 98 and the driven rollers 104, 100 and 106 that are positioned so as to nip sheets P with the transport roller 98 at at least the first convergence position NP1, the second convergence position NP2 and the third convergence position NP3.

The transport unit 36 is provided with the first roller 40, the second roller 42, and the transport driven rollers 50, 44 and 52 that are positioned so as to nip sheets P with the first roller 40 and the second roller 42 at the first convergence position NP1, the second convergence position NP2 and the third convergence position NP3. In the at least two transport rollers, the nipping point NP1 at the first convergence position and the nipping point NP2 at the second convergence position are formed in the second roller 42 on a side that is closer to the recording unit 38.

The transport unit 108 is provided with the plurality of pairs of transport rollers 110, 112 and 114 that respectively form the nipping points NP1, NP2 and NP3 at at least the first convergence position, the second convergence position and the third convergence position.

The printer 10 or 90 is provided with the recording unit 38 that executes recording on sheets P, and the apparatus main body 12 that is provided with the front surface manual insertion unit 24, the back surface feeding unit 26, the medium accommodation unit 28 and the transport unit 36, 96 or 108.

In addition, in the present embodiment, the apparatus main body 12 is applied to an ink jet printer as an example of a recording apparatus according to the invention, but it is also possible to apply the apparatus main body 12 generally to other liquid ejecting devices.

In this instance, liquid ejecting devices are not limited to recording apparatuses such as printers, copy machines and facsimiles, and the like in which an ink jet type recording head is used, and which perform recording on a target recording medium by ejecting ink from the recording head, and the term includes devices that eject, in place of ink, a liquid that corresponds to the application thereof, onto a target ejecting medium that corresponds to a target recording medium by ejecting the liquid onto the target ejecting medium from a liquid ejecting head that corresponds to an ink jet recording head.

Other than the abovementioned recording head, examples of liquid ejecting heads include color material ejecting heads that are used in the production of color filters such as liquid crystal displays, electrode material (conductive paste) ejecting heads that are used in electrode formation such as organic EL displays, Field Emission Displays (FED) and the like, living organic material ejecting heads that are used in the production of biochips, and reagent ejecting heads as precision pipettes.

Additionally, the invention is not limited to the abovementioned examples, various alterations are possible within the range of the invention that is disclosed in the aspects, and such alterations are included within the scope of the invention.

The entire disclosure of Japanese Patent Application No. 2013-217608, filed Oct. 18, 2013 is expressly incorporated by reference herein.

What is claimed is:

1. A medium transport device comprising:

a medium transport pathway that inverts a medium that is supplied from a processing unit that forms an image on the medium, and is configured to transport the medium to the processing unit again after the medium is inverted;

a discharge unit that discharges the medium that is supplied from the processing unit;

a first supply unit that supplies a first medium;

a first convergence unit at which the first supply unit and the medium transport pathway converge;

a second supply unit that supplies a second medium;

a second convergence unit that is positioned further downstream than the first convergence unit, and at which the second supply unit and the medium transport pathway converge;

a first transport roller that has a first driving roller and a first driven roller that is associated with the first driving roller, and that is provided in the first convergence unit;

a second transport roller that has a second driving roller and a second driven roller that is associated with the second driving roller, and that is provided in the second convergence unit; and wherein the first transport roller and the second transport roller are separated, wherein the first driving roller forms a bent portion of the medium transport pathway to invert the medium, wherein the first driving roller inverts the medium supplied from the first supply unit, wherein the second driving roller transports the medium from the first transport roller to the processing unit.

2. The medium transport device according to claim 1, wherein the medium transport pathway includes a reverse transport pathway for reverse face processing that processes a reverse face of a medium by transporting the medium that is supplied from the processing unit to the processing unit again, wherein the reverse transport pathway converges at the first convergence unit.

3. The medium transport device according to claim 2, further comprising:

a third supply unit that supplies a third medium;

a third convergence unit that is positioned at a place in which the third supply unit and the reverse transport pathway of the medium transport pathway converge; and a third transport roller that includes a third driven roller that is associated with the second driving roller, and that is provided in the third convergence unit.

4. The medium transport device according to claim 1, wherein the medium transport pathway for reverse face processing is disposed in a substantially flat manner, and wherein a pathway from the first supply unit that converges with the first convergence unit converges upward from a position below the reverse transport pathway.

5. The medium transport device according to claim 1, wherein diameters of the first driving roller and the second driving roller are the same.

6. The medium transport device according to claim 1, wherein the first driving roller and the second driving roller are configured to be a detachable unit body.

7. A recording apparatus comprising:

a processing unit that performs a process on a medium; and the medium transport device according to claim 1.

* * * * *